US008210089B2

(12) United States Patent
Brown

(10) Patent No.: US 8,210,089 B2
(45) Date of Patent: Jul. 3, 2012

(54) FIREARM HAVING AN INDIRECT GAS IMPINGEMENT SYSTEM

(75) Inventor: Michael J. Brown, Baltimore, MD (US)

(73) Assignee: Adcor Industries, Inc., Baltimore, MD (US)

( * ) Notice: Subject to any disclaimer, the term of this patent is extended or adjusted under 35 U.S.C. 154(b) by 421 days.

(21) Appl. No.: 12/496,000

(22) Filed: Jul. 1, 2009

(65) Prior Publication Data

US 2010/0000400 A1 Jan. 7, 2010

Related U.S. Application Data

(60) Provisional application No. 61/133,624, filed on Jul. 1, 2008, provisional application No. 61/211,288, filed on Mar. 27, 2009.

(51) Int. Cl.

| | |
|---|---|
| ***F41A 5/18*** | (2006.01) |
| ***F41A 5/26*** | (2006.01) |
| ***F41G 1/02*** | (2006.01) |

(52) U.S. Cl. ..... 89/191.02

(58) Field of Classification Search ..... 89/191.01, 89/191.02, 193

See application file for complete search history.

(56) References Cited

U.S. PATENT DOCUMENTS

| | | | |
|---|---|---|---|
| 1,379,989 | A | 5/1921 | Johnson |
| 1,402,459 | A | 1/1922 | Swebilius |
| 1,846,993 | A | 2/1932 | Destree |
| 1,878,038 | A | 9/1932 | Von Frommer |
| 2,341,767 | A | 2/1944 | Gans |
| 2,462,119 | A | 2/1949 | Moore |
| 2,685,754 | A | 8/1954 | Crittendon et al. |
| 2,752,826 | A | 7/1956 | Simpson |
| 2,775,166 | A | 12/1956 | Janson |
| 2,780,145 | A | 2/1957 | Saive |
| 2,783,685 | A | 3/1957 | Green |

(Continued)

FOREIGN PATENT DOCUMENTS

WO 2009/123775 A2 10/2009

OTHER PUBLICATIONS

Article entitled "M26 Modular Accessory Shotgun System" from Wikipedia, the free encyclopdia dated Jun. 2008; http://en.wikipedia.org/wiki/M26_Modular_Accessory_Shotgun_System.

(Continued)

*Primary Examiner* — Troy Chambers

(74) *Attorney, Agent, or Firm* — Howard & Howards Attorneys PLLC

(57) ABSTRACT

A firearm including a barrel having a breech and a muzzle defining a length of the barrel is disclosed. The firearm includes a hand guard having a first end and a second end with a front sight is attached to at least one of the barrel adjacent the muzzle and the second end of the hand guard. A housing is coupled to the front sight and defines a chamber having a piston disposed therein and movable between static and displaced positions. A receiver is coupled to the first end and a bolt carrier is disposed within the receiver and moveable between firing and rearward positions. A carrier key is attached to the bolt carrier and moves concurrently with the bolt carrier and a rod is permanently affixed to the carrier key and extends to a distal end with the piston engaging the distal end when moving to the displaced position.

21 Claims, 17 Drawing Sheets

U.S. PATENT DOCUMENTS 2,882,635 A 4/1959 Hill
2,951,424 A 9/1960 Stoner
3,176,424 A 4/1965 Hoge
3,198,076 A 8/1965 Stoner
3,236,155 A 2/1966 Sturtevant
3,255,667 A 6/1966 Walther
3,300,889 A 1/1967 Baker
3,368,298 A 2/1968 Browning
3,397,473 A 8/1968 Browning
3,405,470 A 10/1968 Wesemann
3,592,101 A 7/1971 Vartanian et al.
3,618,457 A 11/1971 Miller
3,619,926 A 11/1971 Alday
3,675,534 A 7/1972 Beretta
3,686,998 A 8/1972 Seifried
3,742,636 A 7/1973 Dealy et al.
3,771,415 A 11/1973 Into et al.
3,774,498 A 11/1973 Moller et al.
3,776,095 A 12/1973 Atchisson
3,938,271 A 2/1976 Hyytinen
3,938,422 A 2/1976 Tellie
3,960,053 A 6/1976 Conley
3,969,980 A 7/1976 Brandstatter et al.
3,999,461 A 12/1976 Johnson et al.
4,020,741 A 5/1977 Junker
4,044,487 A 8/1977 Hutton et al.
4,088,057 A 5/1978 Nasypany
4,125,054 A 11/1978 Jennie
4,244,273 A 1/1981 Langendorfer, Jr. et al.
4,246,830 A 1/1981 Krieger
4,358,986 A 11/1982 Giorgio
4,389,920 A 6/1983 Dufour, Sr.
4,398,448 A 8/1983 LaFever
4,416,186 A * 11/1983 Sullivan ..... 89/198
4,475,437 A * 10/1984 Sullivan ..... 89/148
4,505,182 A 3/1985 Sullivan
4,553,469 A 11/1985 Atchisson
4,635,530 A 1/1987 Weldle
4,654,993 A 4/1987 Atchisson
4,663,875 A 5/1987 Tatro
4,689,911 A 9/1987 White
4,693,170 A 9/1987 Atchisson
4,703,826 A 11/1987 Byron
4,756,228 A 7/1988 Roth
4,765,224 A 8/1988 Morris
4,766,800 A 8/1988 Miller et al.
4,867,039 A 9/1989 Dobbins
4,893,547 A 1/1990 Atchisson
4,972,617 A 11/1990 Major
5,198,600 A 3/1993 E'Nama
5,343,650 A 9/1994 Swan
5,351,598 A 10/1994 Schuetz
5,540,008 A 7/1996 Kirnstatter
5,821,445 A 10/1998 Guhring
5,824,923 A 10/1998 Kondoh et al.
5,824,943 A 10/1998 Guhring et al.
5,827,992 A 10/1998 Harris et al.
5,918,401 A 7/1999 Rowlands
5,945,626 A 8/1999 Robbins
6,019,024 A 2/2000 Robinson et al.
6,134,823 A 10/2000 Griffin
6,311,603 B1 11/2001 Dunlap
6,418,655 B1 7/2002 Kay
6,453,594 B1 9/2002 Griffin
6,481,145 B2 11/2002 Weichert et al.
6,499,246 B1 12/2002 Zedrosser
6,564,491 B2 5/2003 Murello
6,609,321 B2 8/2003 Faifer
6,619,592 B2 9/2003 Vignaroli et al.
6,625,916 B1 9/2003 Dionne
6,634,274 B1 10/2003 Herring
6,722,255 B2 4/2004 Herring
6,732,466 B2 5/2004 Bentley
6,782,791 B2 8/2004 Moore
6,829,858 B2 12/2004 Gablowski
6,848,351 B1 2/2005 Davies
7,000,345 B1 2/2006 Kay
7,131,228 B2 11/2006 Hochstrate et al.
7,137,219 B2 11/2006 Wössner et al.
RE39,465 E 1/2007 Swan
7,231,861 B1 6/2007 Gauny et al.
7,347,023 B2 3/2008 Woössner et al.
7,418,898 B1 9/2008 Desomma
7,448,307 B1 11/2008 Dafinov
7,461,581 B2 12/2008 Leitner-Wise
7,469,624 B1 12/2008 Adams
7,478,495 B1 1/2009 Alzamora et al.
7,621,210 B2 11/2009 Fluhr et al.
7,637,199 B2 12/2009 Fluhr et al.
7,644,528 B2 1/2010 Wössner et al.
7,779,743 B2 8/2010 Herring
7,832,326 B1 11/2010 Barrett
7,891,284 B1 * 2/2011 Barrett ..... 89/193
8,109,193 B2 * 2/2012 Herring ..... 89/193
2003/0074822 A1 4/2003 Faifer
2005/0115134 A1 6/2005 Bond et al.
2005/0115398 A1 6/2005 Olson
2005/0262752 A1 12/2005 Robinson et al.
2006/0065112 A1 3/2006 Kuczynko et al.
2006/0156606 A1 7/2006 Robinson et al.
2006/0236582 A1 10/2006 Lewis et al.
2006/0254112 A1 11/2006 Snoderly
2007/0033851 A1 2/2007 Hochstrate et al.
2007/0199435 A1 8/2007 Hochstrate et al.
2008/0110074 A1 5/2008 Bucholtz et al.
2009/0000173 A1 1/2009 Robinson et al.
2009/0007477 A1 1/2009 Robinson et al.
2009/0031605 A1 2/2009 Robinson
2009/0031606 A1 2/2009 Robinson et al.
2009/0031607 A1 2/2009 Robinson et al.
2009/0120277 A1 5/2009 Adams

OTHER PUBLICATIONS

Article entitled "M16 rifle" from Wikipedia, the free encyclopedia dated Jun. 2008; http://en.wikipedia.org/wiki/M-16_rifle.
Article entitled "M4 Carbine" from Wikipedia, the free encyclopedia dated Jun. 2008; http://en.wikipedia.org/wiki/M4_carbine.
Animation entitled "How an AR15 Works" from the website dated Jun. 2008; www.barnesengineering.com/AR15animation/index.htm.
Article entitled "The USA's M4 Carbine Controversy" dated Feb. 2, 2009; www.defenseindustrydaily.com/the-usas-m4-carbine-controversy-03289/.
Article entitled "M4 Carbine Review" dated May 2, 2007; http://home.comcast.net/ shooter2_indy/m4.html.
Article entitled "Critics Turn Crosshairs on Military's Main Rifle" dated Apr. 20, 2008 from the website "USA Today"; www.usatoday.com/news/military/2008-04-20-gunwars_N.htm.
Parts Schematic entitled "Schematic for Bushmaster M4A3 Carbine" from the website "Bushmaster" dated Jun. 2008; www.bushmaster.com/electronic-documents/operation-manual/opmanual.pdf.
Article entitled "M26 Modular Accessory Shotgun Systems Photos and Video" from the website "The Firearm Blog" dated Nov. 2, 2007; www.thefirearmblog.com/blog/2007/11/02/m26-modular-accessory-shotgun-system-photos-andvideo/.
Catalog item LMT: Standard MRP (rifle) version from the website "Lewis Machine Tool Company" dated Jun. 2008; www.lewismachine.net/product.php?p=56&cid=8&session=85945e8b595ef2d461b8980961cf870a.

* cited by examiner

FIREARM HAVING AN INDIRECT GAS IMPINGEMENT SYSTEM

CROSS REFERENCE TO RELATED APPLICATIONS

The subject patent application claims priority to and the benefits of U.S. Provisional Patent Application Ser. No. 61/133,624, filed on Jul. 1, 2008 and U.S. Provisional Patent Application Ser. No. 61/211,228, filed on Mar. 27, 2009.

BACKGROUND OF THE INVENTION

1. Field of the Invention

The subject invention relates to firearms and more specifically to firearms having an indirect gas impingement system.

2. Description of the Prior Art

Firearms typically include a receiver that houses several working components of the firearm, including firing components, with a barrel extending from the receiver. There are various classes of firearms that operate in different manners. One class of firearm utilizes a bolt carrier is disposed in the receiver that is moveable between a firing position, from which a live round of ammunition can be fired, and a retracted position, from which a spent casing is ejected. The movement of the bolt carrier and ejection of the casing can be accomplished with a direct gas impingement or indirect gas impingement system. Examples of gas impingement type firearms include the M16, the M4®, such as the M4® carbine, and the AR-15®, such as the AR-15® Platform.

Firearms having the direct gas impingement system typically include an ejection port defined by the receiver. Direct gas impingement systems route exhaust gases back through the firearm to move the bolt carrier toward the retracted position. In particular, after firing the firearm, the direct gas impingement system routes exhaust gases, including any associated debris, from the barrel, back through a return tube to the bolt carrier, and out the ejection port of the receiver.

Firearms having the indirect gas impingement system do not route the exhaust gases back to the bolt carrier in an effort to reduce fouling caused by the exhaust gases that may occur with direct gas impingement type firearms. Instead, the exhaust gases are used to move a device, such as a piston, that engages the bolt carrier to move the bolt carrier toward the rearward position. The device of the prior art utilize multiple components to cause movement of the bolt carrier. Increasing the components causes an unwanted increase in the weight of the firearm. Further, increasing the components also causes serviceability problems with the bolt carrier and the device.

Therefore there remains a need to develop a firearm that utilizes an indirect gas impingement system that is light weight and simplified to provide easy serviceability and/or retrofitting of the components.

SUMMARY OF THE INVENTION AND ADVANTAGES

The present invention provides for a firearm having a barrel defining a first bore extending along a longitudinal axis. The barrel includes a breech and a muzzle defining a length of the barrel. The firearm includes a hand guard defining a second bore extending substantially parallel to the longitudinal axis and having a first end coupled to the breech and a second end spaced from the first end along the longitudinal axis toward the muzzle. A front sight is attached to at least one of the barrel adjacent the muzzle and the second end of the hand guard with a housing coupled to the front sight and defining a chamber extending along a piston axis. A piston is disposed within the chamber of the housing and movable along the piston axis between a static position and a displaced position. The firearm also includes a receiver coupled to the first end of the hand guard and the breech of the barrel with the receiver defining a third bore extending substantially parallel to the longitudinal axis. A bolt carrier is disposed in the third bore of the receiver and moveable relative to the receiver along the longitudinal axis between a firing position and a rearward position. A carrier key is attached to the bolt carrier and moves concurrently with the bolt carrier between the firing and rearward positions with the carrier key extending outwardly above the bolt carrier and along the piston axis. A rod is permanently affixed to the carrier key and extends along the piston axis to a distal end. The piston is adjacent the distal end when in the static position and the piston engages the distal end when moving to the displaced position for moving the bolt carrier from the firing position to the rearward position.

The present invention also provides for a sight assembly for the firearm having the barrel and the hand guard disposed about the barrel. The sight assembly includes the front sight having a body and an extension coupled to the body with the front sight adapted to be attached to one of the barrel and the hand guard. The sight assembly further includes the housing attached to the body and defining the chamber extending along the piston axis. The sight assembly also includes the piston disposed within the chamber of the housing and movable along the piston axis between the static position and the displaced position with the front sight, the housing and the piston removable as a unit for selectively detaching the unit from one of the barrel and the hand guard.

The present invention further provides for a piston housing support system for the firearm including the barrel defining the first bore extending along the longitudinal axis. The piston housing support system further includes the hand guard defining the second bore extending substantially parallel to the longitudinal axis with the hand guard coupled to the barrel. The piston housing support system also includes the front sight attached to at least one of the barrel and the hand guard and the housing coupled to the front sight with a cradle disposed between the front sight and the hand guard. The cradle is complementary in configuration to a portion of the housing for supporting the housing relative to the front sight and the hand guard when the hand guard is disposed over the barrel and for allowing removal of the housing from the front sight when the hand guard is removed from the barrel.

Therefore, the present invention provides for a firearm having an indirect gas impingement system that allows for easy serviceability and retrofitting of the components into existing firearms while maintaining substantially the same weight of existing firearm.

BRIEF DESCRIPTION OF THE DRAWINGS

Other advantages of the present invention will be readily appreciated, as the same becomes better understood by reference to the following detailed description when considered in connection with the accompanying drawings.

DETAILED DESCRIPTION OF THE INVENTION

Figure 1:
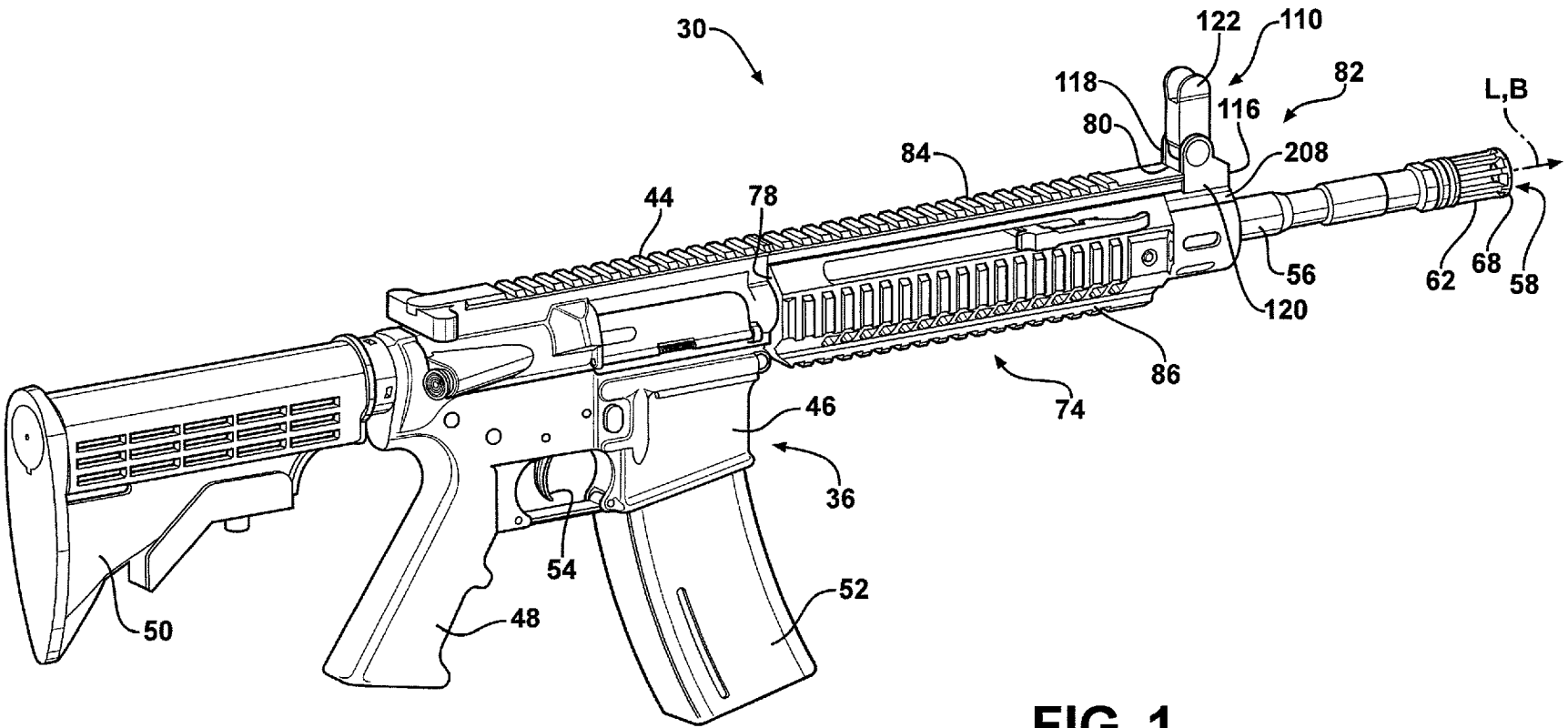
FIG. 1 is a perspective view of a firearm in accordance with the subject invention.
Figure 3A:
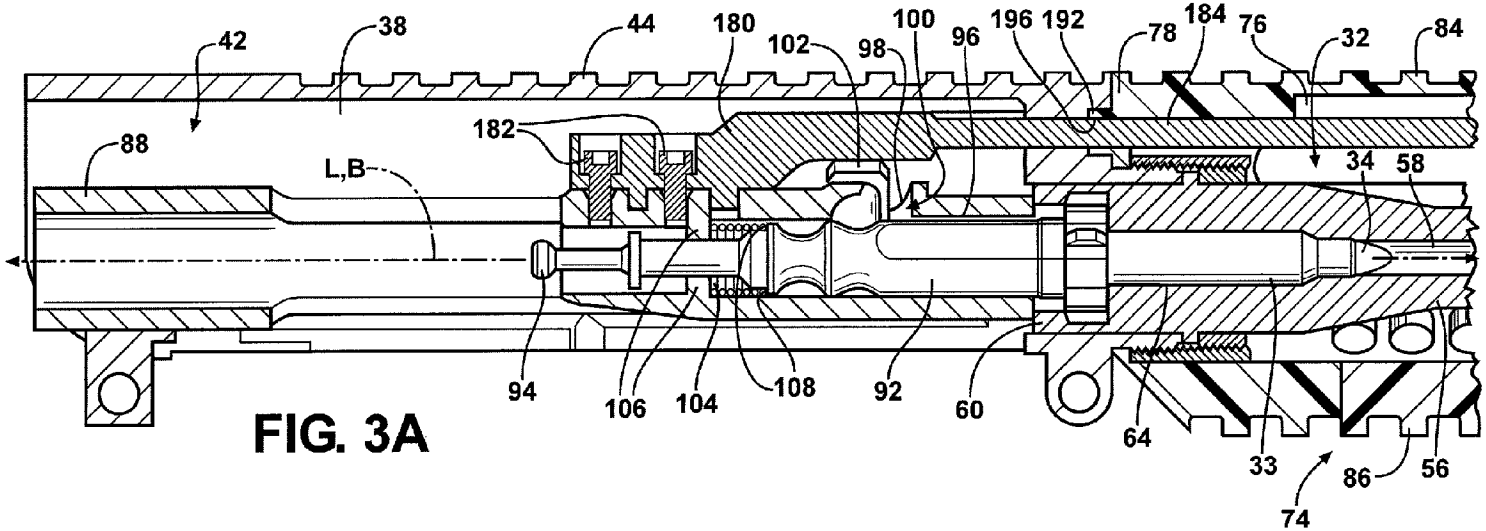
FIG. 3A is a fragmented partial cross-sectional view of the firearm with a bolt carrier in an initial position and a bolt in a first position.
Figure 3B:
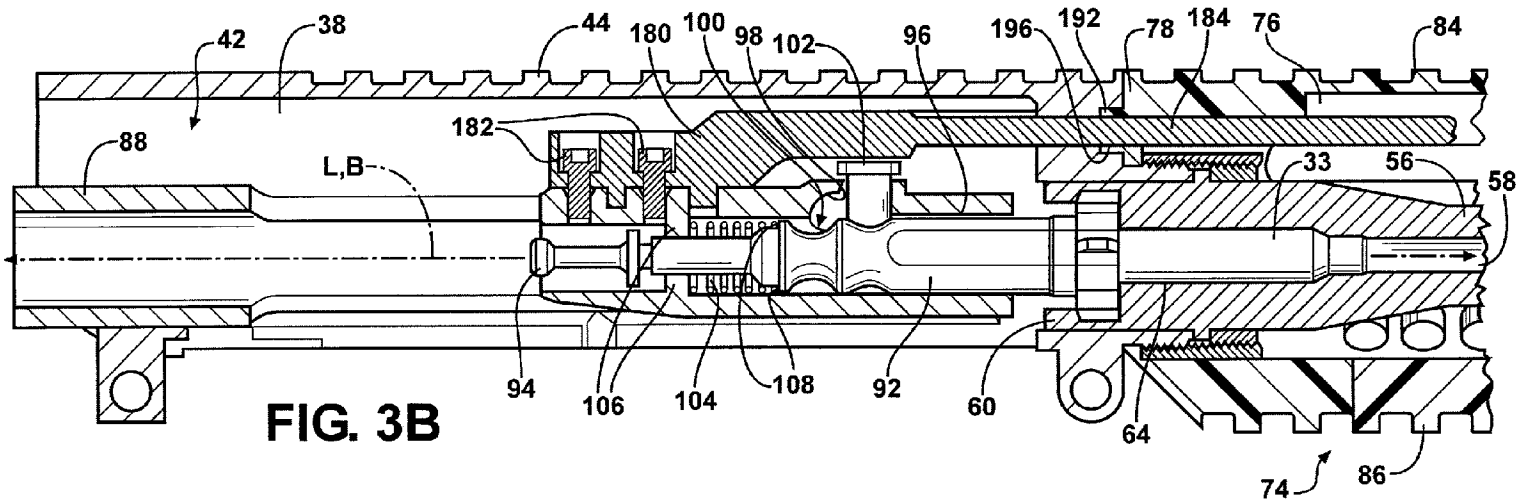
FIG. 3B is a fragmented partial cross-sectional view of the firearm with the bolt carrier in a mid position and the bolt in a second position.

Referring to the Figures, wherein like numerals indicate like or corresponding parts throughout the several views, a firearm 30 is generally shown in FIG. 1. As shown in FIGS. 3A and 3B, the firearm 30 receives and fires a live round 32 of ammunition (hereinafter "live round"), also referred to as a cartridge, which includes a casing 33, a bullet 34, and other components to propel the bullet 34 as known to those skilled in the art.

The firearm 30 can be of a certain class of firearms 30 that utilize a direct gas impingement system or an indirect gas impingement system to eject a spent casing 33 after firing the firearm 30. Examples of such types of firearms 30 include the M16, the M4®, such as the M4® carbine, and the AR-15®, such as the AR-15® Platform. However, it should be appreciated that the firearm 30 can be of any type without departing from the nature of the present invention. The firearm 30 described herein is designed to permit easy retrofitting of the components to a variety of currently and/or previously manufactured firearm 30 designs. The firearm 30 as disclosed herein is primarily utilized in the indirect gas impingement system, as further disclosed below.

Figure 2:
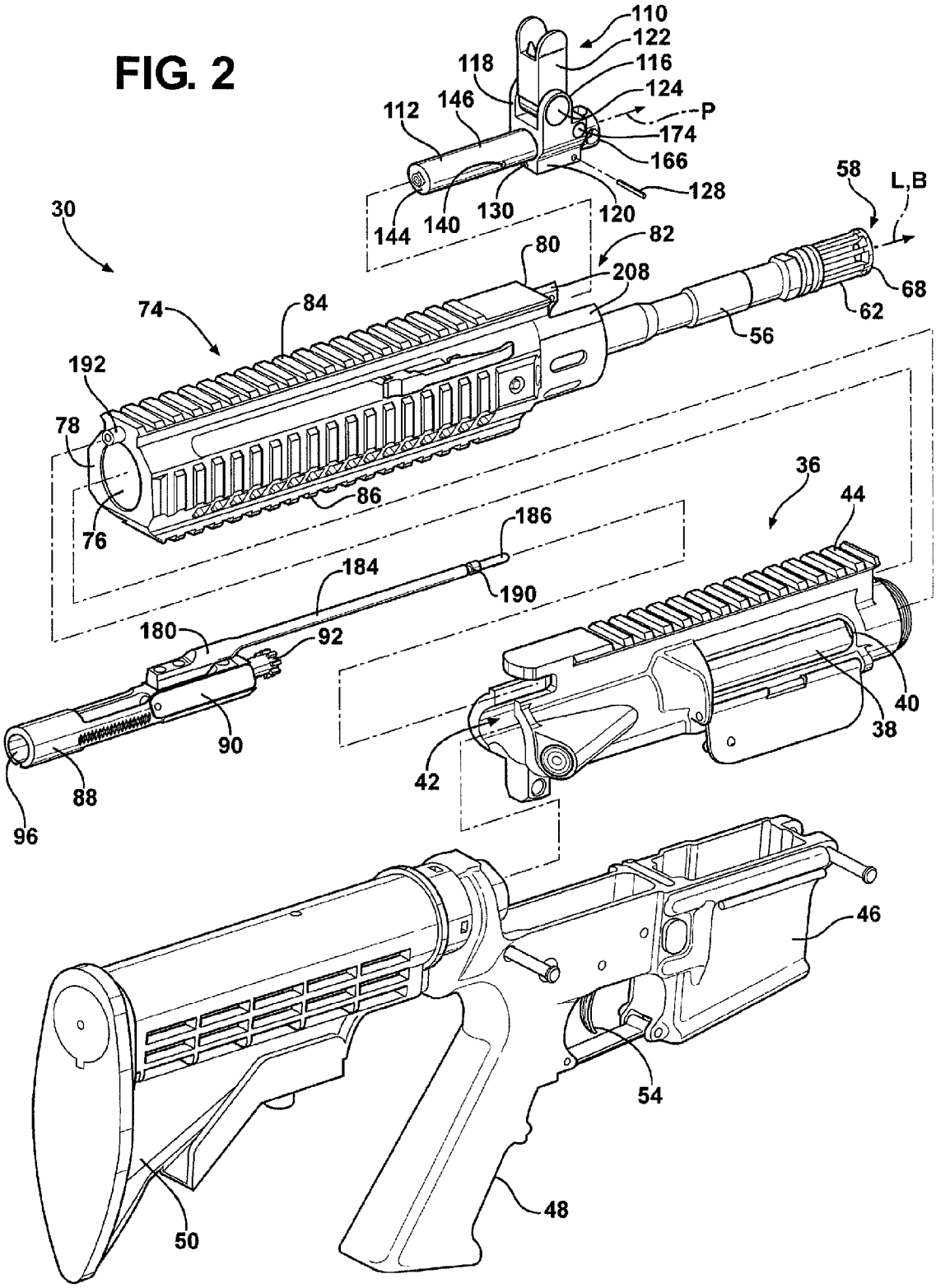
FIG. 2 is an exploded perspective view of the firearm.

As shown in FIGS. 1 and 2, the firearm 30 includes a receiver 36 defining a bore 38 extending substantially parallel to a longitudinal axis L and houses several working components of the firearm 30, such as the firing components, i.e. the action. The bore 38 of the receiver 36 will be referred to as a third bore 38 throughout this description. The receiver 36 defines an ejection port 40 transverse to the longitudinal axis L with the third bore 38 defining an inner surface 42. As known in the art, the receiver 36 is often divided into an upper receiver portion 44 and a lower receiver portion 46 attached to the upper receiver portion 44. The upper receiver portion 44 defines the third bore 38 and the ejection port 40. A hand grip 48 extends downwardly along the lower receiver portion 46 for gripping by the user. A buttstock 50 extends rearwardly from the receiver 36 for supporting the firearm 30 against a shoulder of the user.

A magazine 52, also referred to as a clip, is detachably mounted to the lower receiver portion 46 and can be loaded with a plurality of live rounds 32. The firearm 30 further includes a trigger assembly supported by the receiver 36. The trigger 54 assembly includes a trigger 54 and a hammer (not shown). The trigger 54 is pulled to move the hammer, which, as discussed further below, ultimately results in the firing of the firearm 30.

Figure 4:
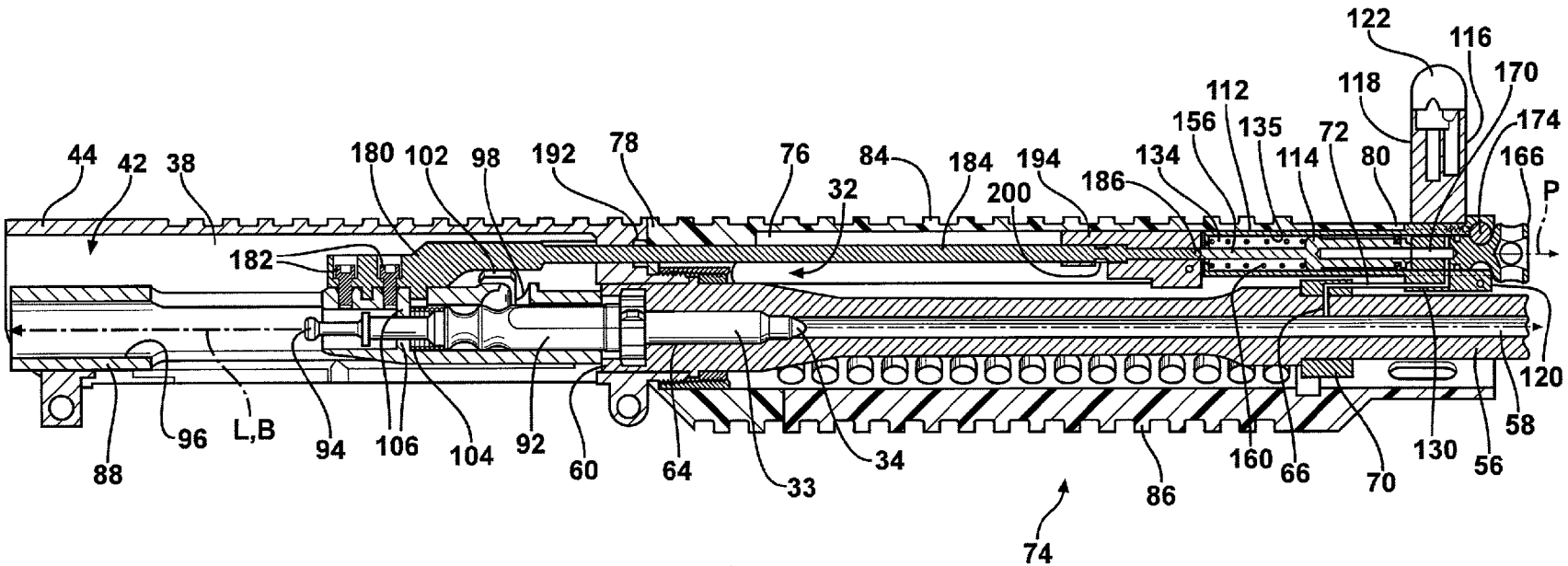
FIG. 4 is a fragmented partial cross-sectional view of the firearm with the bolt carrier in a firing position and a piston in a static position.

As also shown in FIGS. 3A, 3B and 4, a barrel 56 is coupled to the receiver 36 and defines a first bore 58 extending along the longitudinal axis L. As used herein, the phrase "along the longitudinal axis" includes components and/or movements aligning with the longitudinal axis L and/or spaced from and substantially parallel to the longitudinal axis L. The details of how the barrel 56 is coupled to the receiver 36 is further disclosed and claimed in U.S. patent application Ser. No. 12/496,003 filed concurrently with the present application, which is incorporated herein by reference. The barrel 56 includes a breech 60 adjacent the receiver 36 and a muzzle 62 spaced from the breech 60 along the longitudinal axis L. More specifically, the firearm 30 includes the barrel 56 defining the first bore 58 and having the breech 60 and the muzzle 62 defining a length of the barrel 56. The breech 60 defines a chamber 64 extending along the longitudinal axis L for receiving one of the live rounds 32. The chamber 64 will be referred to as a barrel chamber 64 throughout this description. The live rounds 32 are individually loaded into the barrel chamber 64 from the magazine 52. The barrel chamber 64 aligns with the first bore 58 such that the bullet 34 moves out of the barrel chamber 64 and the first bore 58 when firing the firearm 30.

The barrel 56 also defines a first port 66 between the breech 60 and the muzzle 62. Alternatively, the first port 66 may be disposed in the muzzle 62 of the barrel 56. The muzzle 62 includes a distal tip 68 which will be discussed further below. A gas block 70 is attached to the barrel 56 over the first port 66 with the gas block 70 including a tube 72 coupled to the first port 66 for routing exhaust gases away from the barrel 56 after firing the bullet 34.

The firearm 30 includes a hand guard 74 that extends from the receiver 36 circumferentially about the barrel 56 such that a user can hold the hand guard 74 of the firearm 30. More specifically, the hand guard 74 defines a second bore 76 extending substantially parallel to the longitudinal axis L with the hand guard 74 coupled to the barrel 56 and the barrel 56 disposed in the second bore 76. Specifically, the hand guard 74 includes a first end 78 coupled to the breech 60 and a second end 80 spaced from the first end 78 along the longitudinal axis L toward the muzzle 62 such that the hand guard 74 is disposed about the barrel 56.

Figure 5:
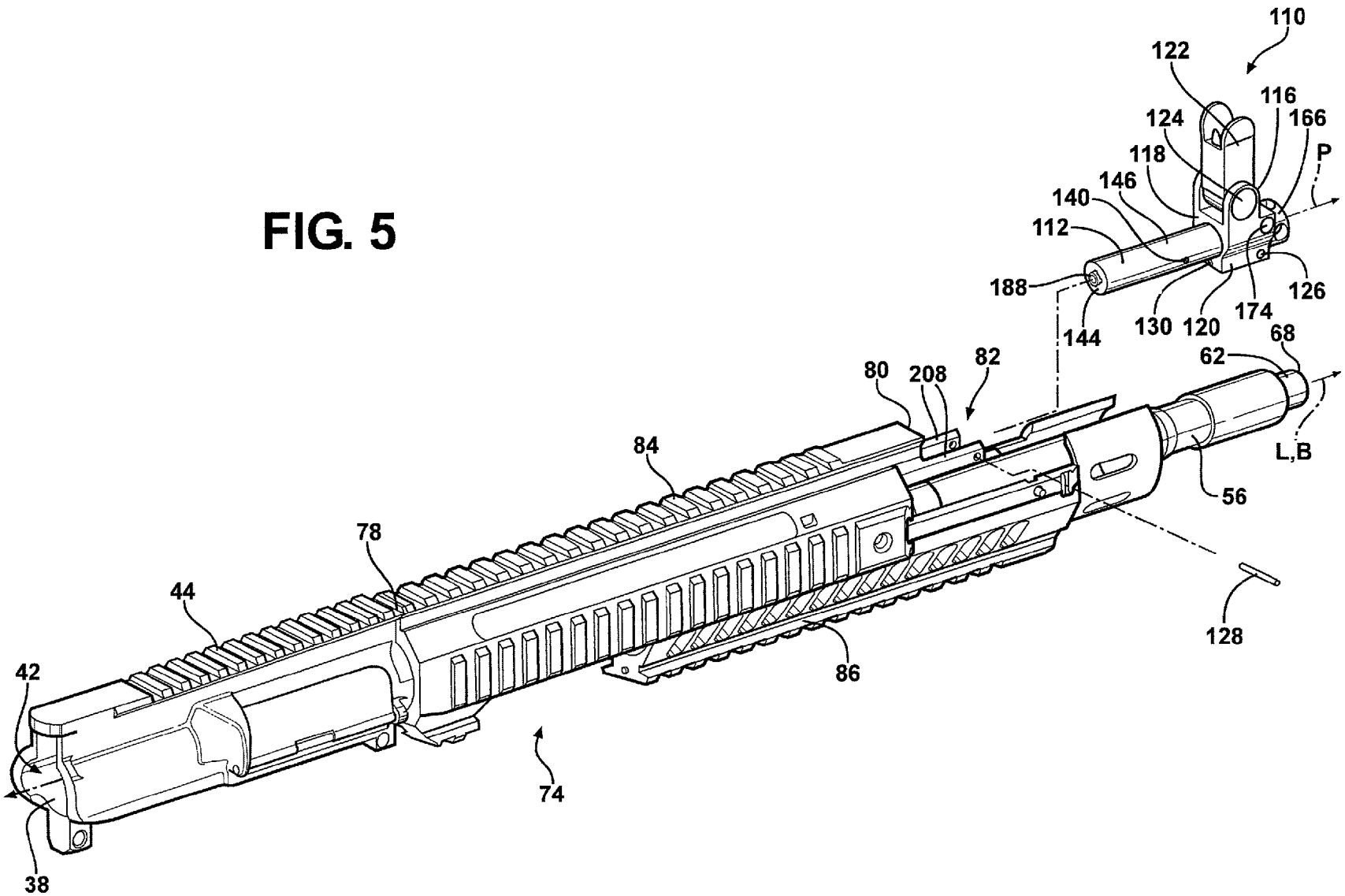
FIG. 5 is an perspective view of a sight assembly exploded from a hand guard having a first hand guard portion and a second hand guard portion with a receiver coupled to the first hand guard portion.

Turning to FIG. 5, the hand guard 74 includes a projection 82 extending from the second end 80 of the hand guard 74. More specifically, the hand guard 74 includes a first hand guard portion 84 and a second hand guard portion 86 slidably coupled to the first hand guard portion 84 with the projection 82 extending from the second end 80 of the first hand guard portion 84. Details of the hand guard 74 are further disclosed and claimed in U.S. patent application Ser. No. 12/496,003 filed concurrently with the present application, which is incorporated herein by reference.

Referring to FIGS. 2, 3A, 3B, 4 and 6, the firearm 30 includes a bolt carrier 88. The receiver 36 is coupled to the first end 78 of the hand guard 74 and the breech 60 of the barrel 56. The bolt carrier 88 is disposed in the third bore 38 of the receiver 36. The bolt carrier 88 is moveable relative to the receiver 36 along the longitudinal axis L between a firing position and a rearward position. A shield 90 is longitudinally affixed to the bolt carrier 88 and movable with the bolt carrier 88 as a unit between the firing and rearward positions along the longitudinal axis L with the shield 90 blocking the ejection port 40 when in the firing position and the shield 90 sliding along the inner surface 42 of the third bore 38 away from the ejection port 40 when moving to the rearward position in conjunction with the bolt carrier 88. Details of the shield 90 are further disclosed and claimed in U.S. patent application Ser. No. 12/496,030 filed concurrently with the present application, which is incorporated herein by reference.

Specifically, a bolt 92 and a firing pin 94 are carried by the bolt carrier 88. More specifically, the firing pin 94 is carried by the bolt 92 and is movable along the longitudinal axis L relative to the bolt 92. The bolt carrier 88 typically has features for automatically releasing another live round 32 from the magazine 52 into the barrel chamber 64 as the bolt carrier 88 moves toward the firing position. As the bolt carrier 88 moves from the rearward position toward the firing position, the bolt carrier 88 catches or pushes another live round 32 into the barrel chamber 64 of the barrel 56. In the firing position, the bolt 92 locks to the breech 60 of the barrel 56 to hold the live round 32 in the barrel chamber 64. The firing components can include the bolt carrier 88, the bolt 92, the firing pin 94, the trigger 54, the hammer and other components as known to those skilled in the art.

When the bolt carrier 88 is in the firing position, the trigger 54 can be pulled to release the hammer, which strikes the firing pin 94. When the hammer strikes the firing pin 94, the firing pin 94 strikes the live round 32 to fire the live round 32, which causes the bullet 34 to move through and out of the first bore 58. After firing the live round 32, the bolt carrier 88 moves by gas impingement toward the rearward position and the casing 33, which is now empty, is expelled from the receiver 36 through the ejection port 40. The bolt carrier 88 automatically moves toward the firing position thereby automatically loading another live round 32 from the magazine 52 into the barrel chamber 64.

Although the firearm 30 shown in the Figures is of the semi-automatic type or the automatic type, it is appreciated that the firearm 30 can also be a single-shot firearm 30 without departing from the nature of the present invention. A semi-automatic firearm 30 is one that fires a single live round 32 when the trigger 54 is pulled and thereafter automatically loads another live round 32. An automatic firearm 30 is one that individually fires multiple live rounds 32 with a single pull of the trigger 54 and continues to load and fire live rounds 32 until the trigger 54 is released. A single-shot firearm 30 requires manual loading of each live round 32 and fires a single live round 32 when the trigger 54 is pulled.

Figure 6:
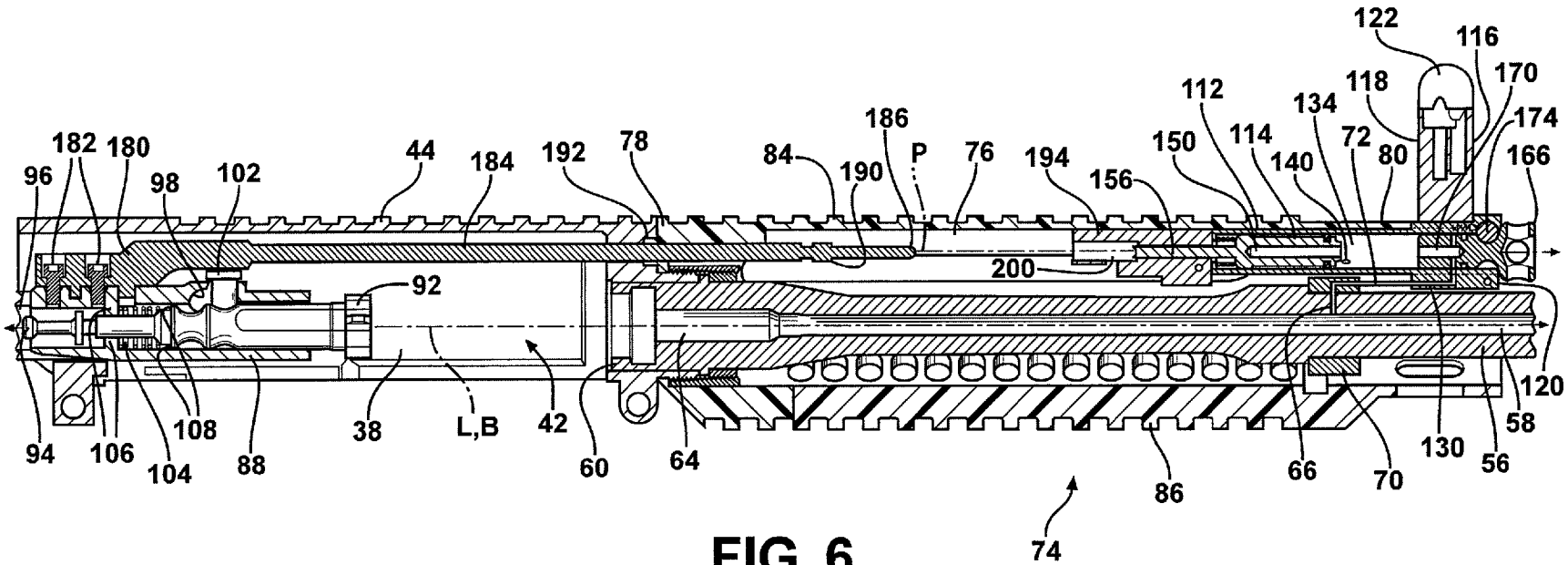
FIG. 6 is a fragmented partial cross-sectional view of the firearm with the bolt carrier in a rearward position and the piston in a displaced position.
Figures 7, 8:
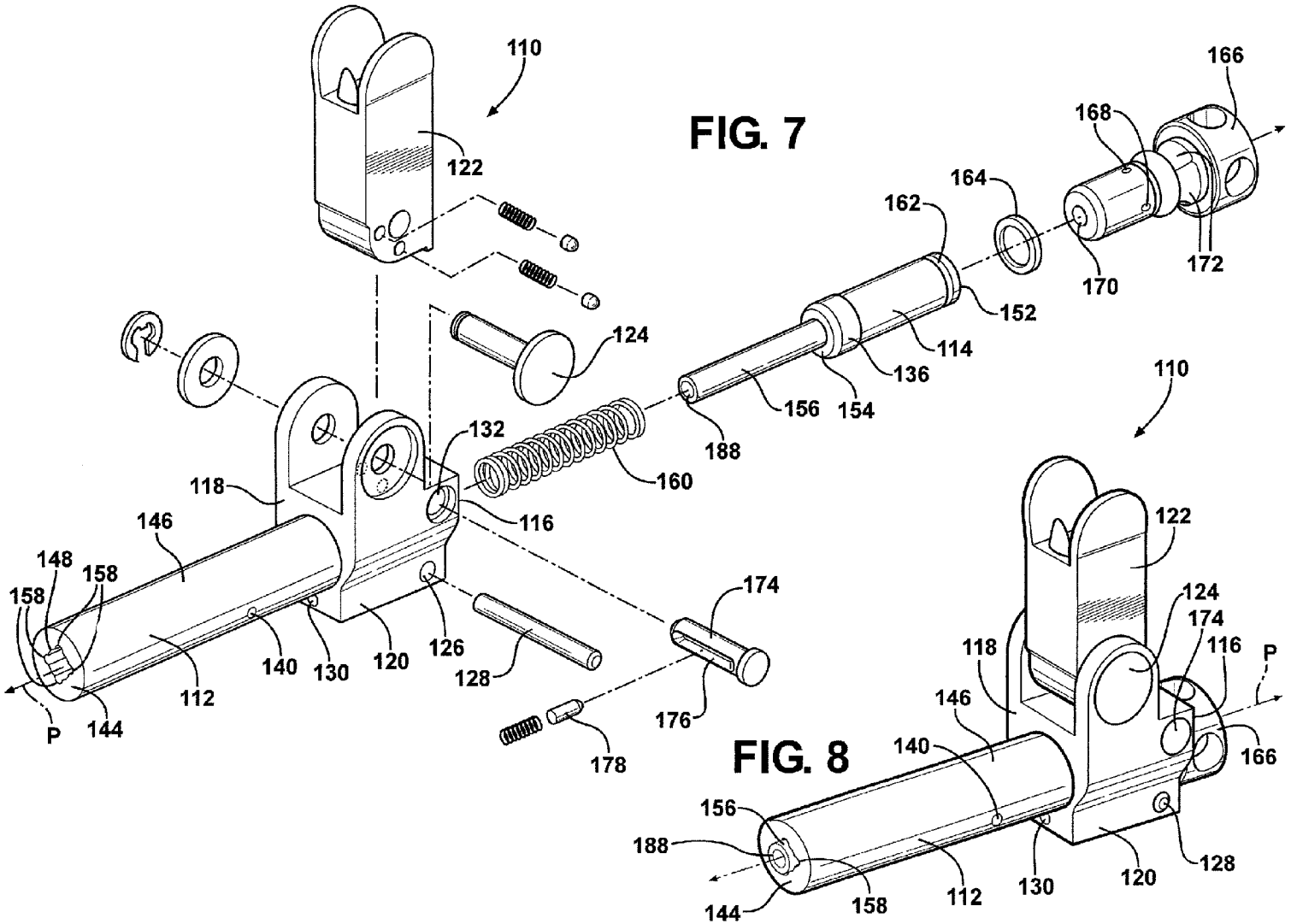
FIG. 7 is an exploded perspective view of the sight assembly.
FIG. 8 is a perspective view of the sight assembly.
Figure 9:
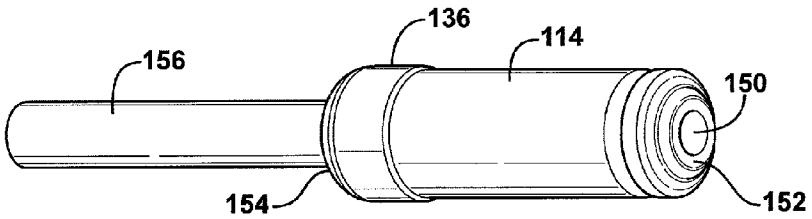
FIG. 9 is a perspective view of the piston of the sight assembly.

Referring to FIGS. 3A and 4, the firing position is defined as when the bolt carrier 88 abuts the breech 60 of the barrel 56 with or without a live round 32 disposed in the barrel chamber 64 of the barrel 56. Referring to FIG. 6, the rearward position is defined as when the bolt carrier 88 moves away from the breech 60 of the barrel 56. More specifically, the rearward position is further defined as when the bolt carrier 88 is spaced from the breech 60 of the barrel 56 after ejecting a spent casing 33 and prior to catching another live round 32 to reload into the barrel chamber 64.

As best shown in FIGS. 3A and 3B, the bolt carrier 88 defines a hole 96 extending along a bolt axis B and moveable between an initial position and a mid position. The hole 96 will be referred to as a carrier hole 96 throughout this description. The initial position of the bolt carrier 88 is defined as the firing position as discussed above and is shown in FIGS. 3A and 4. The mid position of the bolt carrier 88 is further defined as being between the initial/firing positions and the rearward position, as shown in FIG. 3B. Specifically, the mid position is defined as when the bolt carrier 88 is spaced from the breech 60 of the barrel 56 and prior to ejecting the spent casing 33.

As used herein, the phrase "along the bolt axis" includes components and/or movements aligning with the bolt axis B and/or spaced from and substantially parallel to the bolt axis B. Specifically, the bolt axis B is substantially parallel to the longitudinal axis L. More specifically, the bolt axis B aligns with the longitudinal axis L.

The bolt 92 is disposed in the carrier hole 96 of the bolt carrier 88. A cotter pin (not shown) is disposed through the bolt carrier 88 and the carrier hole 96 transverse to the bolt axis B for coupling the bolt 92 to the bolt carrier 88 while allowing independent movement of the bolt 92 relative to the bolt carrier 88. The bolt 92 is movable relative to the bolt axis B between a first position and a second position during movement of the bolt carrier 88 between the initial and mid positions. The first position is shown in FIG. 3A and the second position is shown in FIG. 3B. The first position of the bolt 92 is defined as when the bolt 92 is locked into the breech 60 of the barrel 56 prior to firing the firearm 30. Thus, when the bolt carrier 88 is in the initial position, the bolt 92 is in the first position, which occurs prior to firing the firearm 30. The second position of the bolt 92 is defined as when the bolt 92 rotates about the bolt axis B and unlocks from the breech 60 of the barrel 56 after firing the firearm 30 thus allowing the bolt carrier 88 and the bolt 92 to move to the rearward position. Thus, when the bolt carrier 88 in the mid position, the bolt 92 is in the second position, which occurs after firing the firearm 30. As the bolt 92 moves from the first position to the second position, the bolt 92 rotates to unlock the bolt 92 from the breech 60 of the barrel 56 for allowing the bolt carrier 88 and the bolt 92 to continue to move to the rearward position.

The bolt carrier 88 further defines a slit 98 having a cammed surface 100 and further includes a cam pin 102 disposed through the slit 98 and movable along the slit 98. The cam pin 102 is attached to the bolt 92 such that the bolt 92 rotates as the cam pin 102 rides along the cammed surface 100 as the bolt 92 moves between the first and second positions. A biasing member 104 is disposed between the bolt carrier 88 and the bolt 92 for continuously biasing the bolt 92 into the second position. Specifically, the bolt carrier 88 includes a first skirt 106 extending into the carrier hole 96 and spaced from the slit 98 and the bolt 92 includes a second skirt 108 extending outwardly with the biasing member 104 abutting the first and second skirts 106, 108 for continuously biasing the bolt 92 into the second position. The biasing member 104 may be further defined as a spring or any other suitable biasing member 104 for continuously biasing the bolt 92 into the second position. Utilizing the biasing member 104 with the bolt 92 eliminates the need for gaskets.

Referring to FIGS. 4, 5 and 7-9, a front sight 110, a housing 112 and a piston 114 define a sight assembly for the firearm 30 having the hand guard 74 disposed about the barrel 56. In addition, the front sight 110, the housing 112, the piston 114, the barrel 56 and the hand guard 74 disposed over the barrel 56 define a removable sight system. The front sight 110 is attached to at least one of the barrel 56 adjacent the muzzle 62 and the second end 80 of the hand guard 74. Specifically, the front sight 110 is adapted to be attached to one of the barrel 56 and the hand guard 74. More specifically, the front sight 110 is attached to the second end 80 of the hand guard 74. The front sight 110 includes a front side 116 and a back side 118 spaced from each other relative to the longitudinal axis L with the muzzle 62 defined as a distance from the front side 116 of the front sight 110 to the distal tip 68.

Figure 14:
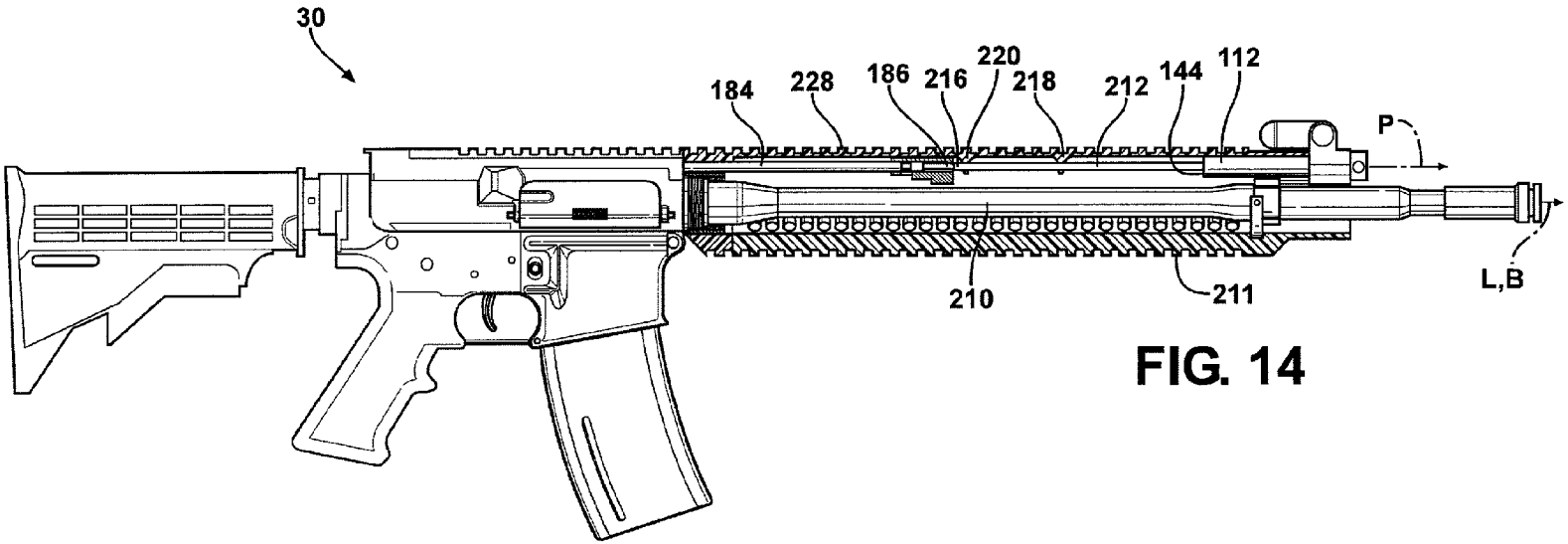
FIG. 14 is a partial cross-sectional view of the second embodiment of the firearm.
Figure 15:
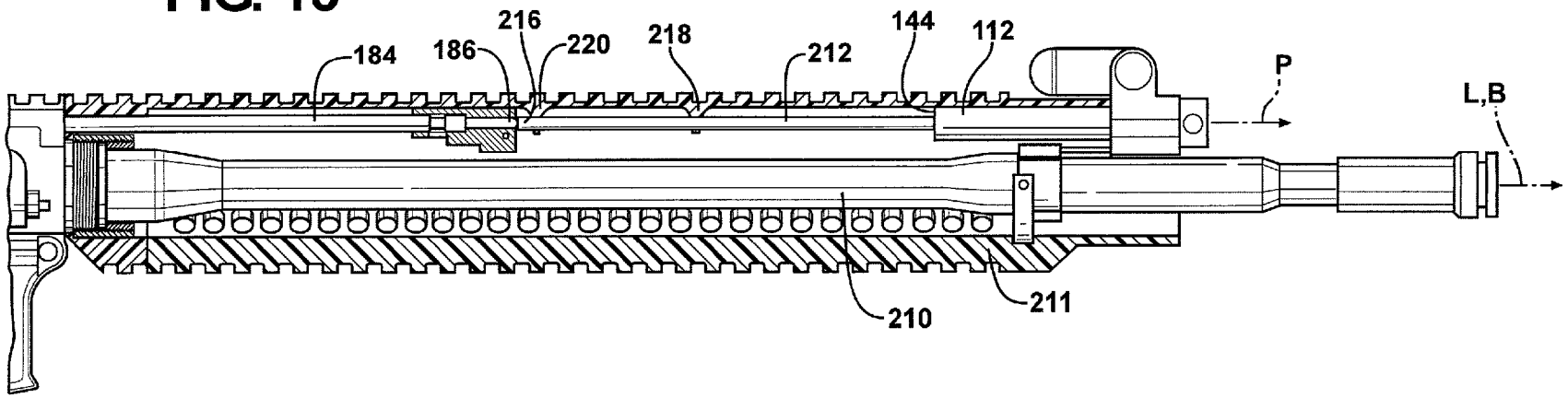
FIG. 15 is an enlarged partial cross-section view of the second embodiment of the firearm.

The front sight 110 further includes a body 120 and an extension 122 coupled to the body 120 with the projection 82 of the hand guard 74 supporting the body 120 of the front sight 110. A sight pin 124 is disposed through the body 120 and the extension 122 for coupling the extension 122 to the body 120. The extension 122 is movable relative to the sight pin 124 between a down position preventing use of the extension 122 and an up position allowing use of the extension 122. The up position is shown in FIGS. 1, 2 and 4-8 and the down position is shown in FIGS. 14 and 15. Referring back to FIGS. 4, 5 and 7, the body 120 defines an orifice 126 with a mounting pin 128 removably disposed through the orifice 126 for selectively detaching the front sight 110 from one of the barrel 56 and the hand guard 74. The body 120 further defines a passageway 130 and a hollow 132 spaced from each other, which will be discussed further below.

The housing 112 is coupled to the front sight 110 and defines a chamber 134 extending along a piston axis P. The chamber 134 is referred to as a first chamber 134 throughout this description. Specifically, the housing 112 is attached to the body 120 of the front sight 110 and the body 120 is attached to the second end 80 of the hand guard 74. More specifically, the housing 112 and the body 120 are integrally formed to each other. As used herein, the phrase "along the piston axis" includes components and/or movements aligning with the piston axis P and/or spaced from and substantially parallel to the piston axis P. Specifically, the piston axis P is spaced from and substantially parallel to the longitudinal axis L. The piston 114 is disposed within the first chamber 134 of the housing 112 and movable along the piston axis P between a static position and a displaced position. The static position is shown in FIGS. 4 and 10 and the displaced position is shown in FIG. 6.

Turning to FIG. 5, the housing 112 and the piston 114 are removable as a unit from one of the barrel 56 and the hand guard 74. More specifically, the front sight 110, the housing 112 and the piston 114 are removable as a unit for selectively detaching the unit from one of the barrel 56 and the hand guard 74. The mounting pin 128 is removably disposed through the orifice 126 of the body 120 for selectively detaching the unit from one of the barrel 56 and the hand guard 74. More specifically, the front sight 110, the housing 112 and the piston 114 are removable as the unit from the hand guard 74. The housing 112 and the piston 114 as described herein are easily retrofitted into existing firearms 30 and provide easy serviceability due to the components being removable as a unit. In addition, the housing 112, the piston 114 and the front sight 110 as described herein are easily retrofitted into existing firearms and provide easy serviceability due to the components being removable as a unit.

Figure 10:
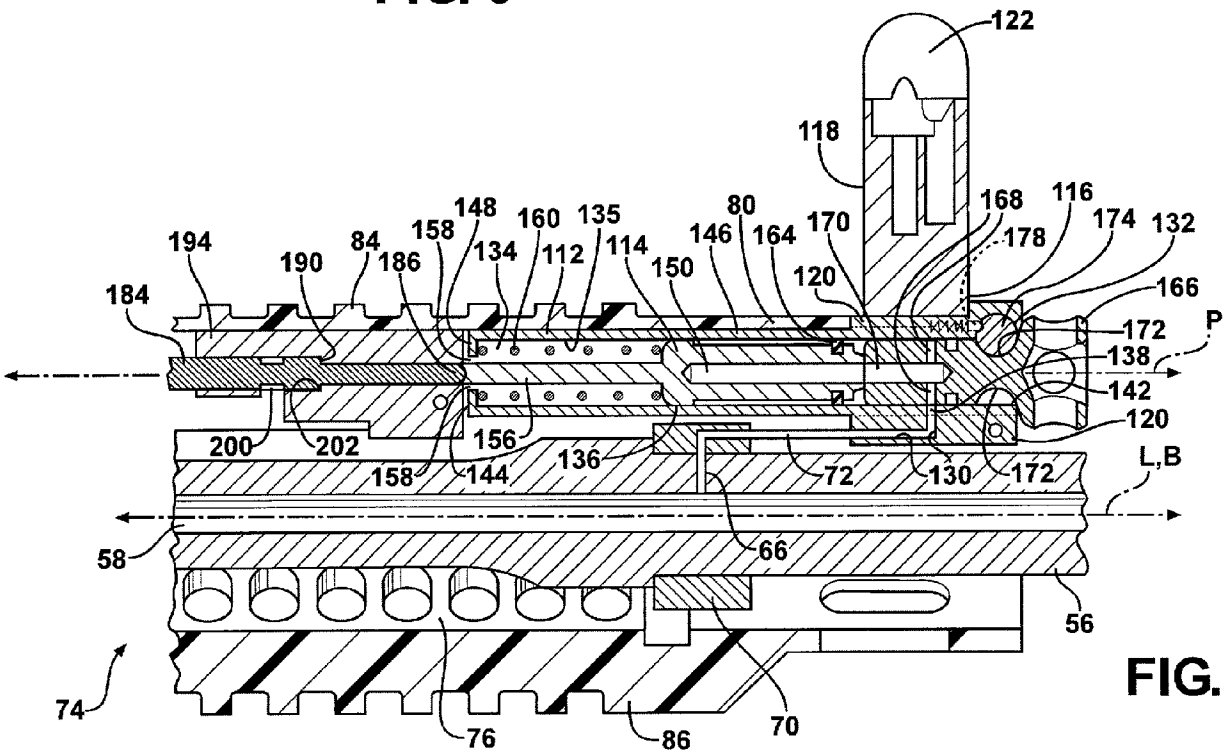
FIG. 10 is an enlarged fragmented cross-sectional view of the sight assembly mounted to the hand guard.

As best shown in FIG. 10, the first chamber 134 of the housing 112 defines an inner surface 135 and the piston 114 defines an outer surface 136 with the outer surface 136 of the piston 114 abutting the inner surface 135 of the housing 112. At least one of the inner and outer surfaces 135, 136 are plated with a self lubricating material for reducing friction between the housing 112 and the piston 114 as the piston 114 moves between the static and displaced positions. The self lubricating material is typically a thermoplastic material. Suitable thermoplastic materials include a fluoropolymer material, such as polytetrafluoroethylene, e.g. PTFE. One example of the thermoplastic material is sold under the brand name Teflon® commercially available by DuPont®. Other suitable plastics include nylon 12, such as Lauramid® and Nyaltron®; polyoxymethylene; phenolic composites; or combinations thereof. It is to be appreciated that other self lubricating materials may also be used for the plating of the inner surface 135 and/or the outer surface 136. In addition, the self-lubricating material can include a non-galling material.

The passageway 130 of the body 120 is spaced from the piston axis P for routing exhaust gases toward the first chamber 134 of the housing 112 to move the piston 114 to the displaced position. Specifically, the tube 72 is coupled to the first port 66 and the passageway 130 for routing exhaust gases from the barrel 56 to the piston 114. More specifically, the housing 112 defines a port 138 in fluid communication with the first port 66 and the passageway 130 for routing exhaust gases into the first chamber 134 of the housing 112 to move the piston 114 from the static position to the displaced position. The port 138 of the housing 112 is referred to as a second port 138 throughout this description.

The housing 112 further defines a bleed-off port 140 transverse to the piston axis P for expelling exhaust gases out of the first chamber 134 and into the hand guard 74 when the piston 114 is in the displaced position. Specifically, the housing 112 includes a front end 142, a back end 144 and a central portion 146 disposed between the front and back ends 142, 144 with the central portion 146 defining the second port 138 and the bleed-off port 140. The housing 112 also defines a first diameter and a second diameter less than the first diameter to define a rim 148 therebetween with the first diameter being complimentary in configuration to the piston 114 and more specifically complimentary in configuration to the outer surface 136 of the piston 114.

The piston 114 defines a first cavity 150 disposed along the piston axis P for receiving gases routed through the second port 138 to move the piston 114 from the static position to the displaced position. The piston 114 includes a front surface 152 and a back surface 154 spaced from each other relative to the piston axis P with the back surface 154 having a shaft 156 extending along the piston axis P and the first cavity 150 extending from the front surface 152 toward the back surface 154. The second diameter of the housing 112 is complimentary in configuration to the shaft 156.

The housing 112 defines a plurality of gaps 158 between the second diameter and the shaft 156 for allowing air and/or debris to expel out of the first chamber 134 as the piston 114 moves from the static position to the displaced position. A spring 160 is disposed around the shaft 156 within the housing 112 for continuously biasing the piston 114 to the static position. The outer surface 136 of the piston 114 defines a groove 162 with a seal 164 or gasket disposed in the groove 162 and abutting the inner surface 135 of the housing 112 for preventing exhaust gases from leaking therethrough. A piston assembly is defined by the housing 112, the piston 114, the spring 160 and the seal 164.

The sight assembly further includes a regulator 166 partially disposed in the housing 112 with the piston 114 abutting the regulator 166 when in the static position (as shown in FIGS. 4 and 10) and spaced from the regulator 166 when in the displaced position (as shown in FIG. 6). Specifically, the front surface 152 of the piston 114 abuts the regulator 166 when in the static position. Also referring to FIG. 7, the regulator 166 defines a plurality of apertures 168 each having a different diameter for regulating pressure on the piston 114 as exhaust gases move through one of the apertures 168 toward the piston 114. One of the apertures 168 is in fluid communication with the second port 138 of the housing 112 for routing exhaust gases from the barrel 56 to the first chamber 134 of the housing 112. The regulator 166 further defines a second cavity 170 disposed along the piston axis P and transverse to the apertures 168 with the second cavity 170 in fluid communication with the first cavity 150 and the apertures 168. More specifically, the second cavity 170 aligns with the first cavity 150 for routing exhaust gases from one of the apertures 168 through the second cavity 170 and into the first cavity 150 to move the piston 114 from the static position to the displaced position.

The regulator 166 also defines a plurality of notches 172 adjacent the apertures 168 with one of the notches 172 substantially parallel to the hollow 132 of the body 120. A gas block pin 174 is dispose through the hollow 132 and abuts one of the notches 172 for selectively coupling the regulator 166 to the housing 112. The gas block pin 174 defines a slot 176 with a retaining pin 178 engaging the slot 176 for allowing the gas block pin 174 to move back and forth through the hollow 132 while remaining coupled to the hollow 132. The gas block pin 174 disengages from one of the notches 172 to allow rotation of the regulator 166 about the piston axis P and the gas block pin 174 engages another one of the notches 172 such that another one of the apertures 168 is in fluid communication with the second port 138 of the housing 112 after rotation of the regulator 166. Specifically, by rotating the regulator 166, another aperture 168 having another diameter is in fluid communication with the second port 138 and the first cavity 150 for regulating or adjusting pressure on the piston 114.

Turning back to FIGS. 4 and 6, the firearm 30 also includes a carrier key 180 attached to the bolt carrier 88. The carrier key 180 moves concurrently with the bolt carrier 88 between the firing and rearward positions with the carrier key 180 extending outwardly above the bolt carrier 88 and along the piston axis P. The carrier key 180 prevents rotation of the bolt carrier 88 during movement between the firing and rearward positions and ensures proper positioning and operation of the shield 90. A plurality of fasteners 182 are disposed through the carrier key 180 and into the bolt carrier 88 to attach the carrier key 180 to the bolt carrier 88 to allow concurrent movement of the carrier key 180 and the bolt carrier 88.

A rod 184 is permanently affixed to the carrier key 180 and extends along the piston axis P to a distal end 186. The piston 114 is adjacent the distal end 186 when in the static position and the piston 114 engages the distal end 186 when moving to the displaced position for moving the bolt carrier 88 from the firing position to the rearward position. The shaft 156 of the piston 114 extends along the piston axis P for engaging the distal end 186 of the rod 184 when exhaust gases move into the first chamber 134. The shaft 156 defines a depression 188 along the piston axis P and faces the distal end 186 of the rod 184 to define a striking end for selectively striking the distal end 186 of the rod 184. As the piston 114 and the shaft 156 move to the displaced position, the striking end engages the rod 184 to move the bolt carrier 88 to the rearward position. Once the piston 114 and the shaft 156 are in the displaced position, the rod 184 and the bolt carrier 88 continue to move to the rearward position with the rod 184 becoming spaced from the striking end.

The rod 184 is further defined as a solid rod 184. The solid rod 184 defines a first outer diameter and a second outer diameter less than the first outer diameter to define a shoulder 190 therebetween. Preferably, the solid rod 184 and the carrier key 180 are integrally formed of a homogeneous metal material with the bolt carrier 88, the carrier key 180 and the solid rod 184 removable as a unit from the receiver 36. More specifically, the bolt carrier 88, the bolt 92, the carrier key 180 and the solid rod 184 are removable as a unit from the receiver 36. The homogenous metal material of the solid rod 184 and the carrier key 180 is typically an alloy. Suitable alloys include aluminum and/or iron alloys, e.g. steel. It is to be appreciated that other metal materials may also be used for the solid rod 184 and the carrier key 180. The bolt carrier 88, the bolt 92, the carrier key 180 and the solid rod 184 as described herein are easily retrofitted into existing firearms 30. In addition, the bolt carrier 88, the bolt 92, the carrier key 180 and the solid rod 184 are easily removed from the firearm 30 by merely separating the upper and lower receiver portions 44, 46 and pulling the bolt carrier 88 out of the third bore 38, thus providing easy serviceability of the components.

As best shown in FIGS. 4 and 6, the firearm 30 further includes a first bushing 192 coupled to the hand guard 74 adjacent the first end 78 and a second bushing 194 coupled to the hand guard 74 adjacent the second end 80. Also referring to FIG. 11, the first bushing 192 defines a first hole 196 along the piston axis P with the solid rod 184 continuously disposed through the first hole 196 for guiding the solid rod 184 during movement between the firing and rearward positions. The first bushing 192 further defines a plurality of splines 198 spaced from each other within the first hole 196 for reducing heat buildup and expelling debris as the solid rod 184 moves back and forth through the first bushing 192 between the firing and rearward positions. The first bushing 192 and the hand guard 74 are integrally formed of a homogeneous metal material. The homogenous metal material of the first bushing 192 and the hand guard 74 is typically an alloy. Suitable alloys include aluminum and/or iron alloys, e.g. steel. It is to be appreciated that other metal materials may also be used for the first bushing 192 and the hand guard 74.

The second bushing 194 defines a second hole 200 along the piston axis P with the solid rod 184 disposed in the second hole 200 when in the firing position and the solid rod 184 spaced from the second hole 200 when in the rearward position. The second bushing 194 is further defined as a base 201 slideably supported by the hand guard 74 and movable between a charging motion and a forward assist motion. The base 201 is adjacent the back end 144 of the housing 112. The base 201 is a component of a handle assembly and details of the handle assembly are further disclosed and claimed in U.S. patent application Ser. No. 12/496,008 filed concurrently with the present application, which is incorporated herein by reference. As best shown in FIG. 10, the second hole 200 of the second bushing 194 defines a first inner diameter and a second inner diameter less than the first inner diameter to define a lip 202 therebetween with the shoulder 190 of the solid rod 184 and the lip 202 engaging each other when in the firing position.

Figure 11:
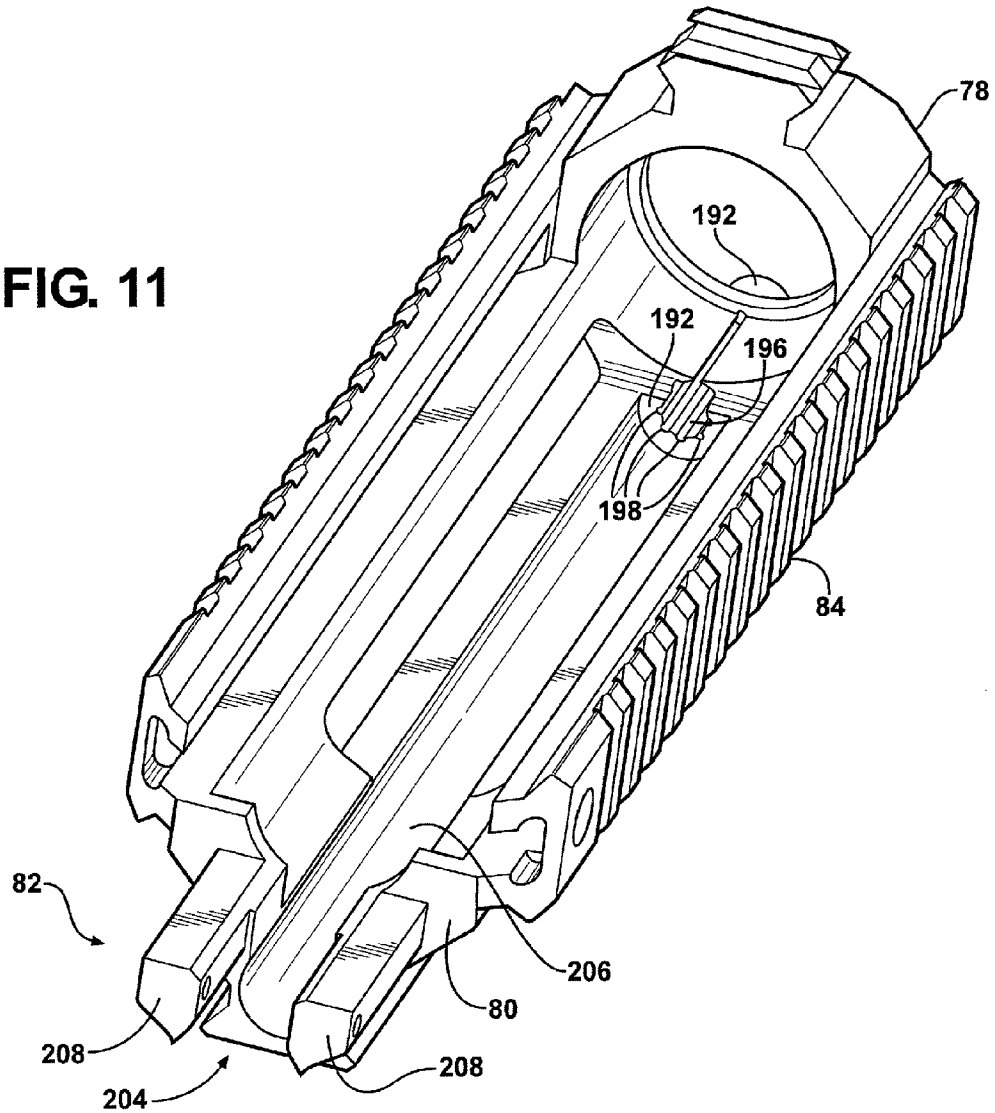
FIG. 11 is a perspective interior view of the first hand guard portion.
Figure 12:
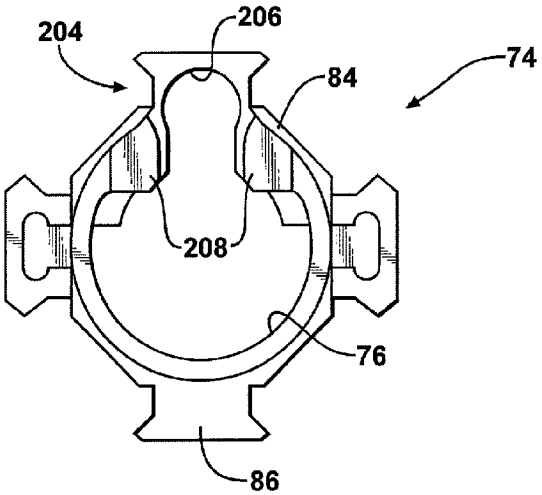
FIG. 12 is an end view of the first and second hand guard portions coupled to each other.

As best shown in FIGS. 5, 11 and 12, the firearm 30 includes a first support 204 coupled to the hand guard 74 adjacent the second end 80 with the front sight 110 and the housing 112 being supported by the first support 204. Specifically, the first support 204 and the hand guard 74 are integrally formed of a homogenous metal material. The homogenous metal material of the first support 204 and the hand guard 74 is typically an alloy. Suitable alloys include aluminum and/or iron alloys, e.g. steel. It is to be appreciated that other metal materials may also be used for the first support 204 and the hand guard 74. Alternatively, the first support 204 can be attached to the hand guard 74 by fasteners, welding, adhesive or any other suitable method. The first support 204 includes a seat 206 supporting the housing 112. The first support 204 further includes the projection 82 extending from the second end 80 of the hand guard 74 and supporting the body 120 of the front sight 110. The seat 206 extends more than half way around the central portion 146 of the housing 112 for supporting the housing 112. In the most preferred embodiment, the projection 82 includes a pair of fingers 208 with the body 120 disposed between the fingers 208.

Figure 13:
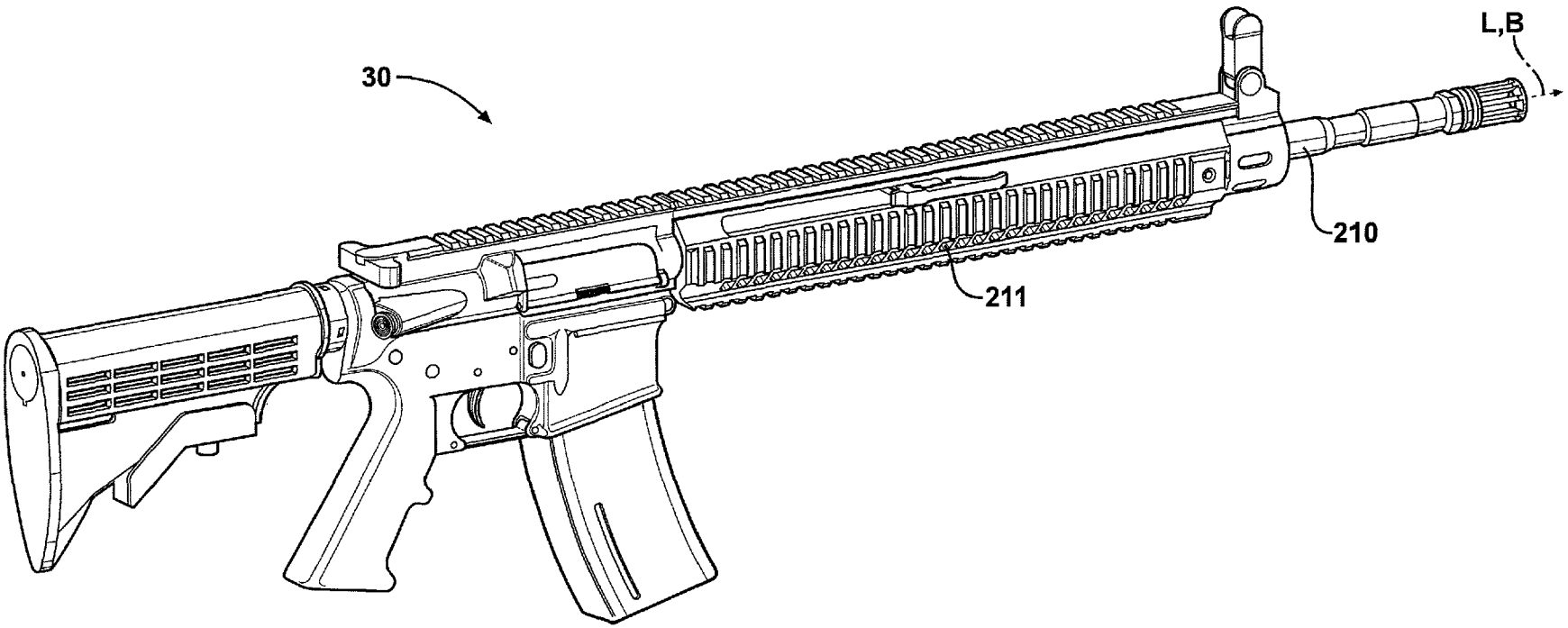
FIG. 13 is a perspective view of a second embodiment of the firearm.

The first embodiment of the firearm 30 can be a version of the M4®, including a shorter barrel 56 typically associated with the M4®, is shown in FIGS. 1-12. A second embodiment of the firearm 30 can be a version of the M16, including a longer barrel 210 typically associated with the M16, is shown in FIGS. 13-17. As shown in FIGS. 13-15, both the barrel 210 and a hand guard 211 are elongated. The back end 144 of the housing 112 is now spaced a greater distance from the base 201. As such, a shaft 212 of a piston 214 extends out of the housing 112 along the piston axis P a greater distance toward the distal end 186 of the rod 184 for engaging the distal end 186 as discussed above. In other words, the shaft 212 of the piston 214 is elongated for allowing a striking end 216 of the shaft 212 to engage the distal end 186 of the rod 184.

Figure 16:
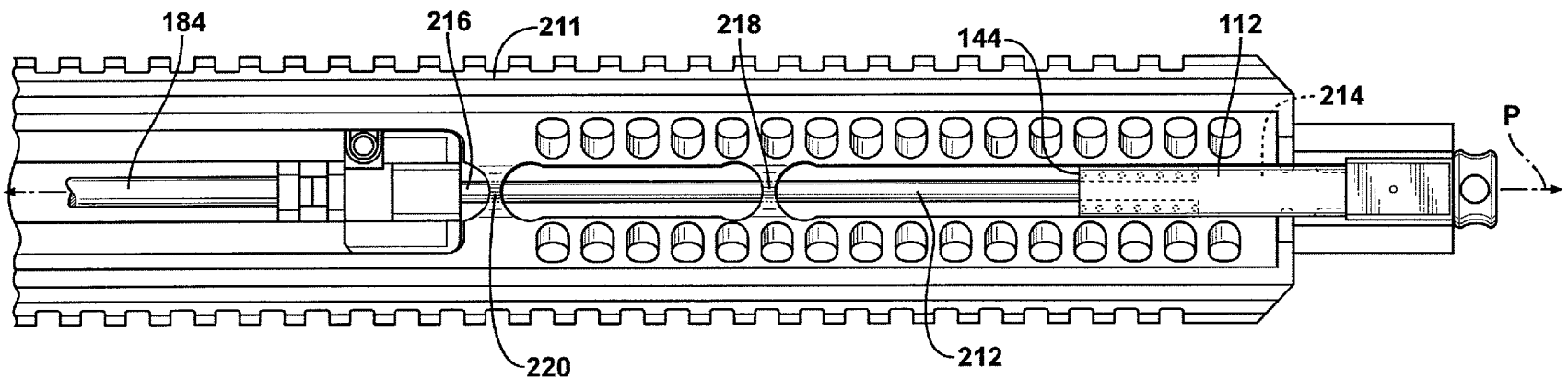
FIG. 16 is an interior plan view of a first hand guard portion of the second embodiment of the firearm.
Figure 17:
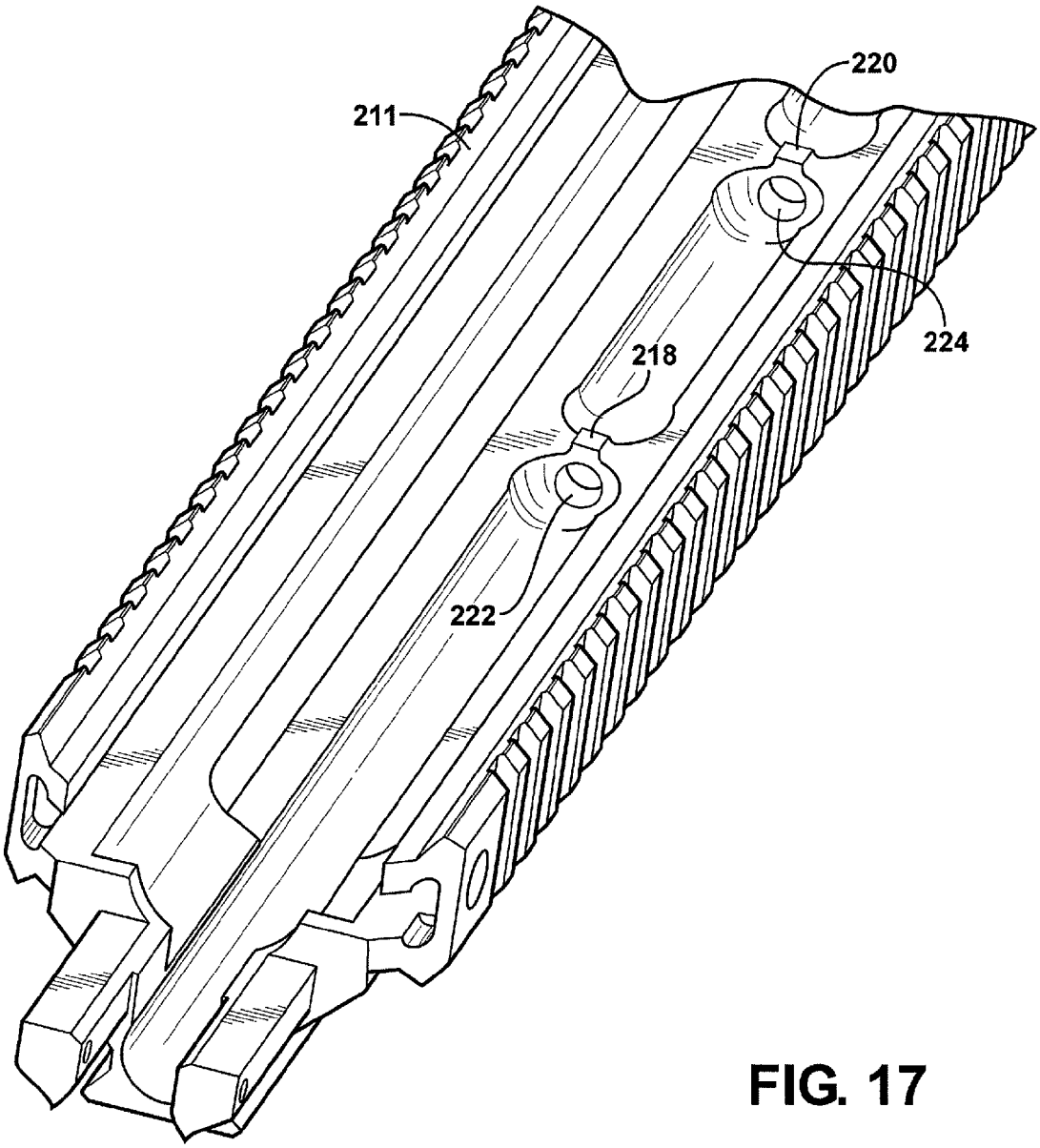
FIG. 17 is a perspective interior view of the first hand guard portion of the second embodiment of the firearm.
Figure 18:
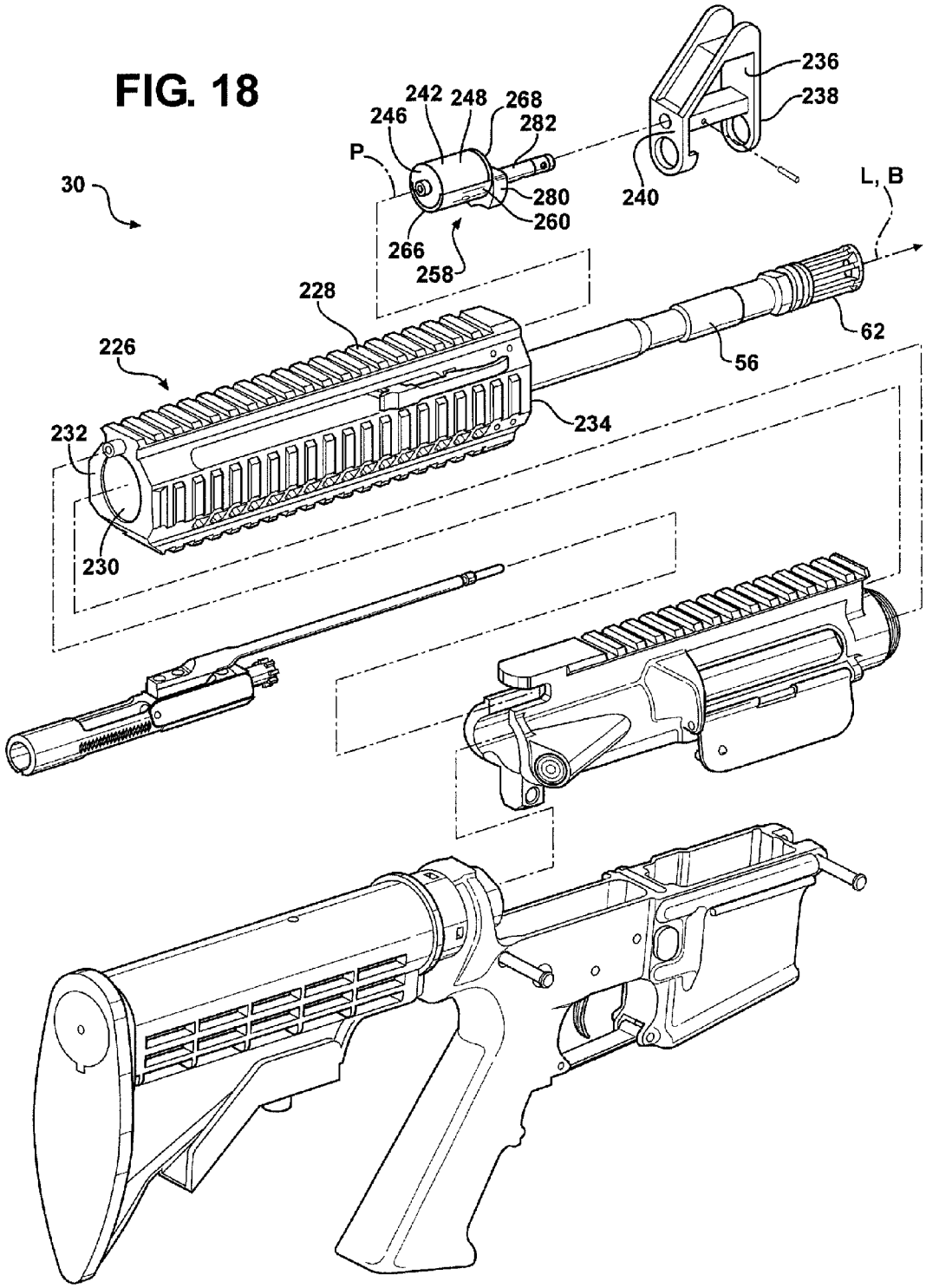
FIG. 18 is an exploded perspective view of a third embodiment of the firearm.

As best shown in FIGS. 15-17, a second support 218 and a third support 220 are utilized for supporting and guiding the elongated shaft 212 during movement between the static and displaced positions. The second and third supports 218, 220 are spaced from each other and coupled to the hand guard 211. Specifically, the second and third supports 218, 220 and the hand guard 211 are integrally formed of a homogenous metal material. The homogenous metal material of the second and third supports 218, 220 and the hand guard 211 is typically an alloy. Suitable alloys include aluminum and/or iron alloys, e.g. steel. It is to be appreciated that other metal materials may also be used for the second and third supports 218, 220 and the hand guard 211. Alternatively, the second and third supports 218, 220 can be attached to the hand guard 211 by fasteners, welding, adhesive or any other suitable method.

The second support 218 is coupled to the hand guard 211 and spaced from the first support 204 with the second support 218 defining a first passage 222 along the piston axis P. The shaft 212 is continuously disposed through the first passage 222 during movement of the piston 214 between the static and displaced positions. The third support 220 is coupled to the hand guard 211 adjacent the distal end 186 of the rod 184 with the second support 218 disposed between the first and third supports 204, 220. Specifically, the third support 220 is adjacent the base 201. The third support 220 defines a second passage 224 along the piston axis P and the shaft 212 is continuously disposed through the second passage 224 during movement of the piston 214 between the static and displaced positions.

Turning to FIGS. 18-24, a third embodiment of the firearm 30 is disclosed. Specifically, this third embodiment discloses a piston housing support system for the firearm 30. The piston housing support system includes the barrel 56 as discussed above with a slightly modified hand guard 226. The hand guard 226 of this embodiment includes a first hand guard portion 228 without the projection 82 as discussed above. The hand guard 226 defines a second bore 230 extending substantially parallel to the longitudinal axis L with the hand guard 226 coupled to the barrel 56. Specifically, the hand guard 226 includes a first end 232 coupled to the breech 60 of the barrel 56 and a second end 234 spaced from the first end 232 along the longitudinal axis L toward the muzzle 62 of the barrel 56 such that the hand guard 226 is disposed about the barrel 56.

The piston housing support system further includes a front sight 236 attached to at least one of the barrel 56 and the hand guard 226. More specifically, the front sight 236 is attached to the barrel 56 and includes a front side 238 and a back side 240 spaced from each other relative to the longitudinal axis L.

Figure 19:
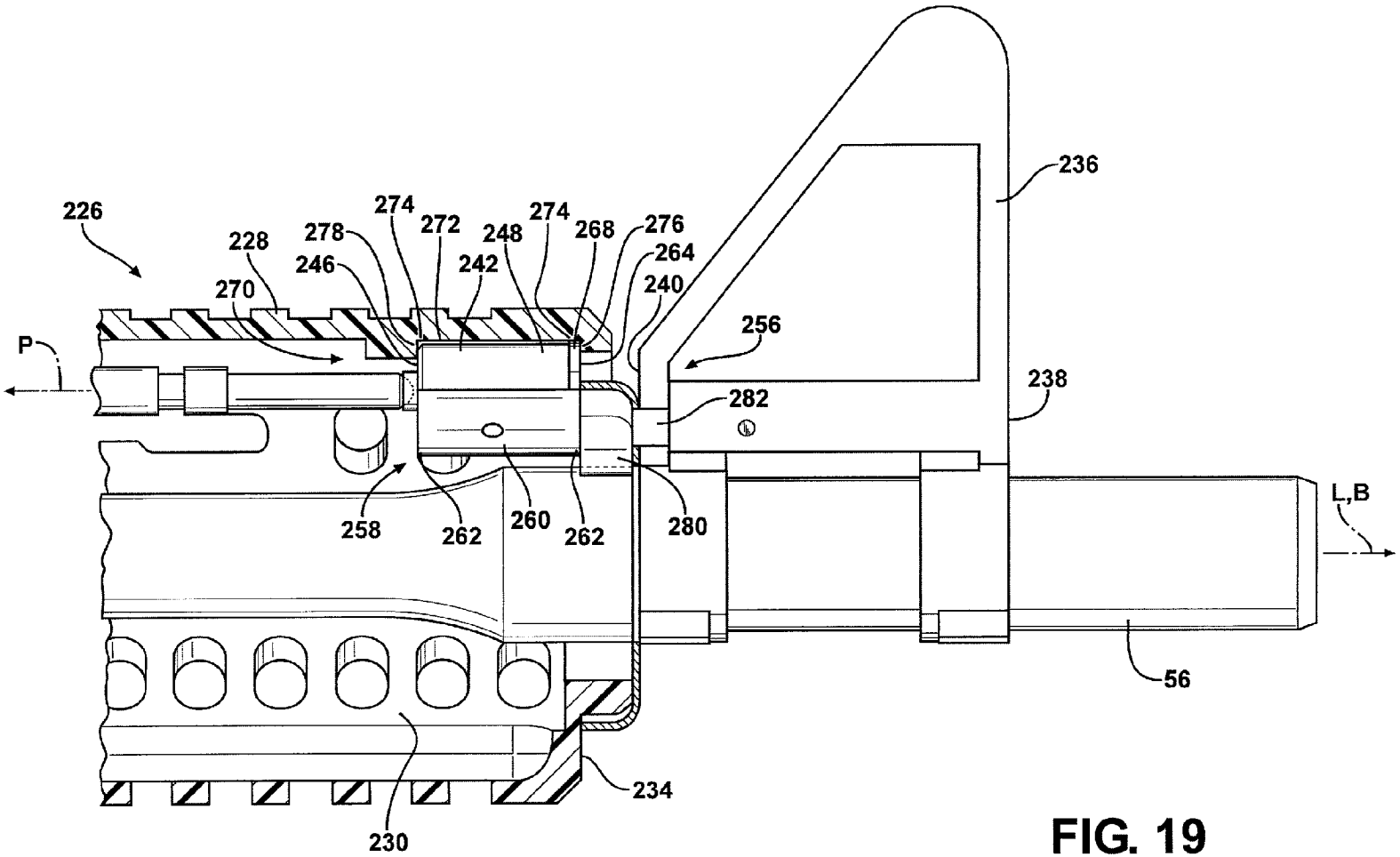
FIG. 19 is a fragmented partial cross-sectional view of a piston housing support system of the third embodiment of the firearm.
Figure 20:
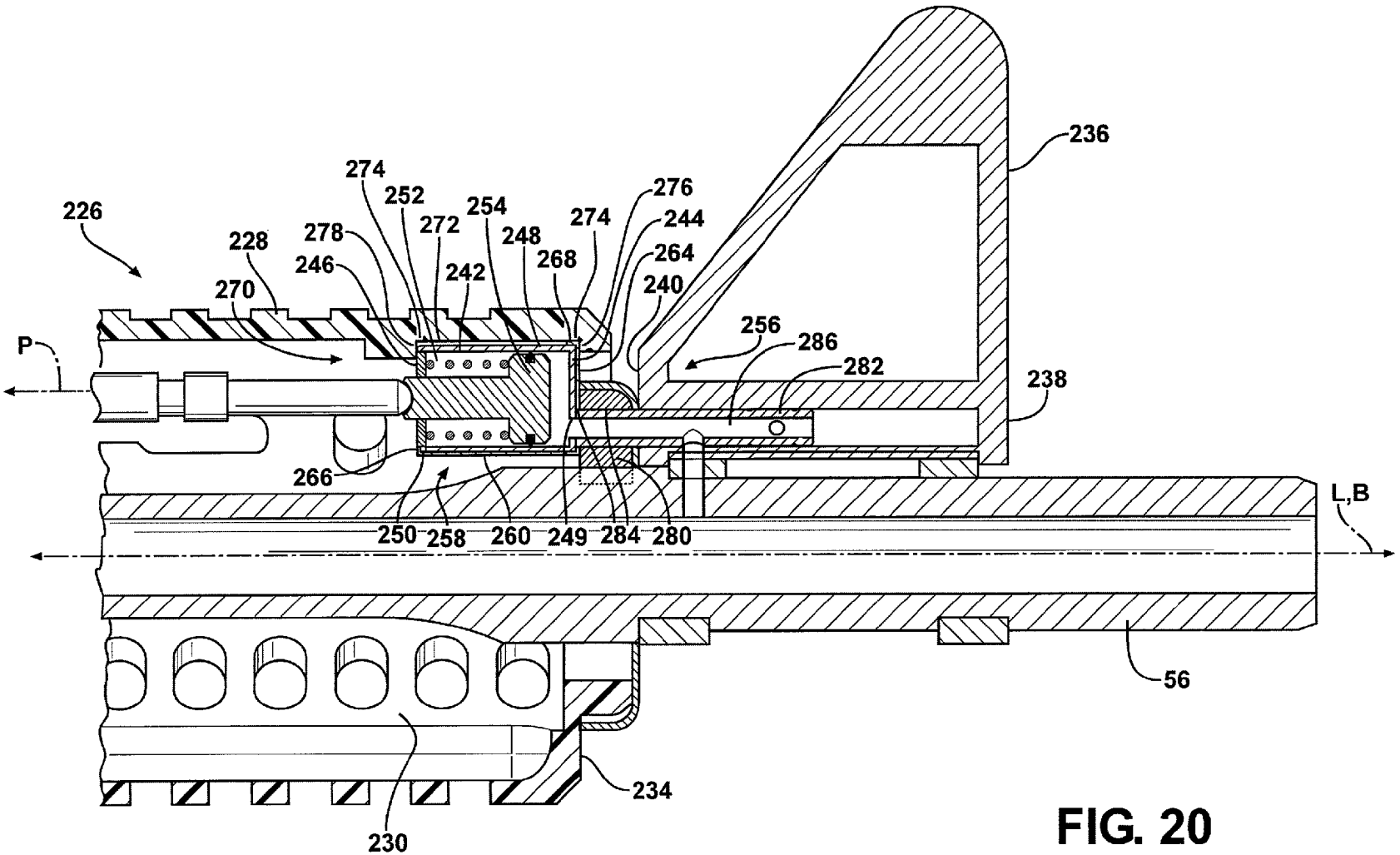
FIG. 20 is a cross-sectional view of the piston housing support system of the third embodiment of the firearm.
Figure 21:
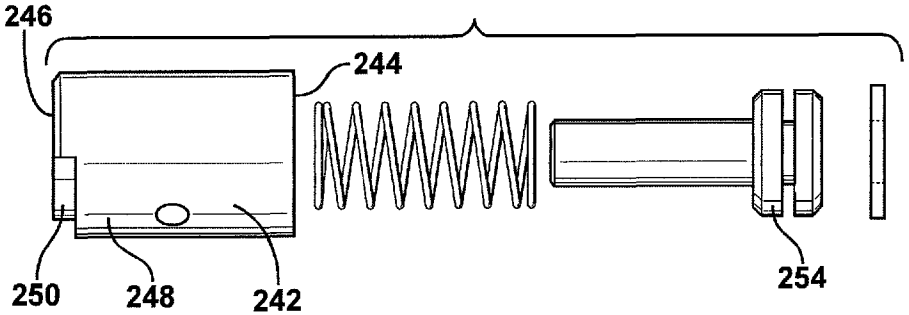
FIG. 21 is an exploded side view of a piston assembly of the third embodiment.

Referring to FIGS. 19-21, the piston housing support system further includes a housing 242 coupled to the front sight 236 and more specifically, the housing 242 is coupled to the back side 240 of the front sight 236. The housing 242 includes a front end 244, a back end 246 and a central portion 248 disposed between the front and back ends 244, 246 with the front end 244 defining a second port 249. The back end 246 of the housing 242 defines a cutout 250 extending a first predetermined distance toward the front end 244 which will be discussed further below. The housing 242 defines a chamber 252 extending along a piston axis P between the front and back ends 244, 246. The chamber 252 is referred to as a first chamber 252 throughout this description. The piston housing support system further includes a piston 254 disposed within the first chamber 252 and movable along the piston axis P between a static position and a displaced position. A piston assembly includes the housing 242, the piston 254, a spring and a seal.

The piston housing support system further includes a cradle 256 disposed between the front sight 236 and the hand guard 226. The cradle 256 is complementary in configuration to a portion of the housing 242 for supporting the housing 242 relative to the front sight 236 and the hand guard 226 when the hand guard 226 is disposed over the barrel 56 and for allowing removal of the housing 242 from the front sight 236 when the hand guard 226 is removed from the barrel 56.

Figure 22:
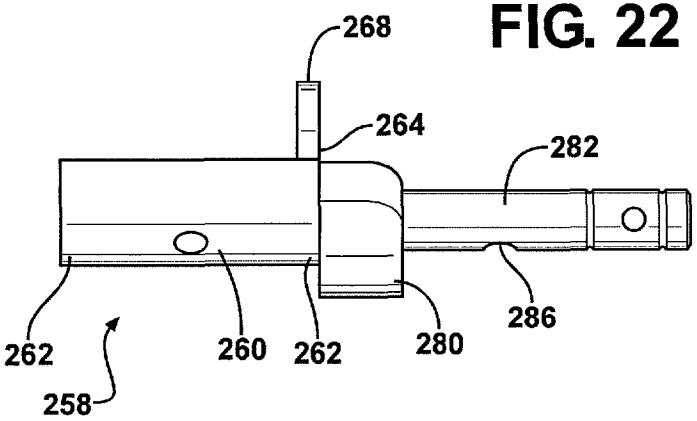
FIG. 22 is a side view of a first segment of a cradle of the third embodiment.
Figure 23:
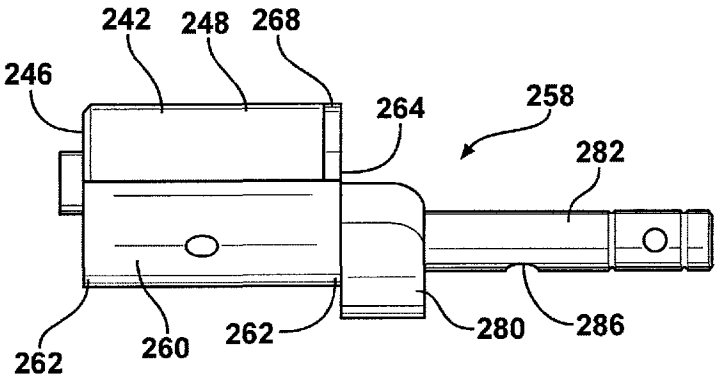
FIG. 23 is a side view of the piston assembly disposed within the first segment of the third embodiment.
Figure 24:
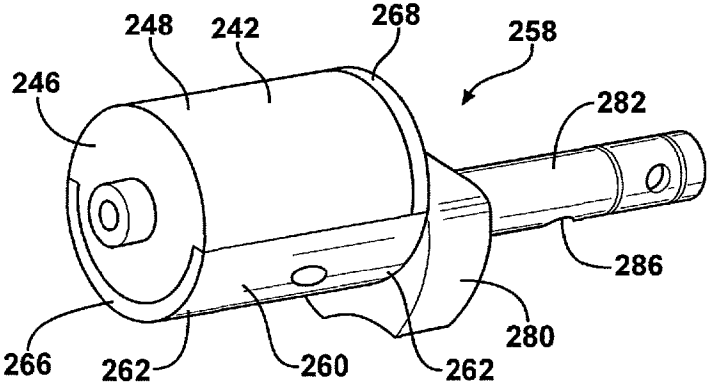
FIG. 24 is a perspective view of the piston assembly disposed within the first segment of the third embodiment.

Also referring to FIGS. 22-24, the cradle 256 further includes a first segment 258 coupled to the front sight 236 for supporting the housing 242. The first segment 258 includes a first base 260 engaging the central portion 248 of the housing 242 with the first base 260 having a pair of base ends 262 and a first flange 264 extending from one of the base ends 262 and abutting the front end 244 of the housing 242. The first base 260 further includes a second flange 266 extending from another one of the base ends 262 and disposed adjacent the back end 246 of the housing 242.

The first flange 264 includes an edge 268 extending outwardly a second predetermined distance toward the back end 246 of the housing 242 with the edge 268 engaging the central portion 248 of the housing 242 for supporting the housing 242. The edge 268 and the first base 260 are substantially parallel to each other with the housing 242 disposed therebetween with the second flange 266 extending into the cutout 250 of the second end 234. The first and second predetermined distances of the cutout 250 and the edge 268 respectively are substantially equal for moving the housing 242 into and out of the first base 260. For example, when removing the housing 242 from the first segment 258, the housing 242 is moved backward to disengage the edge 268 of the first flange 264 from the central portion 248 of the housing 242 and the cutout 250 of the housing 242 moves backward until the housing 242 abuts the second flange 266, at which time the housing 242 is removable from the first base 260.

Referring to FIGS. 19 and 20, the cradle 256 also includes a second segment 270 formed in the hand guard 226 and spaced substantially parallel to the first segment 258 for supporting the housing 242 therebetween. Specifically, the second segment 270 is formed in the second end 234 of the hand guard 226. More specifically, the second segment 270 is formed in the second end 234 of the first hand guard portion 228. Once the first hand guard portion 228 is removed, the second segment 270 is spaced from the housing 242 and the first segment 258. Spacing the second segment 270 from the first segment 258 allows the housing 242 and the piston 254 to be removable from the first segment 258 as a unit for providing easy serviceability of the housing 242 and the piston 254.

The second segment 270 includes a second base 272 engaging the central portion 248 of the housing 242 with the second base 272 having a pair of base ends 274 and a third flange 276 extending from one of the base ends 274 of the second base 272. The third flange 276 opposes the first flange 264 with the third flange 276 abutting one of the front end 244 of the housing 242 and the first flange 264 when the hand guard 226 is disposed over the barrel 56. More specifically, the third flange 276 abuts the first flange 264 with the edge 268 of the first flange 264 abutting the second base 272. The second base 272 further includes a fourth flange 278 extending from another one of the base ends 274 of the second base 272. The fourth flange 278 opposes the second flange 266 with the fourth flange 278 adjacent the back end 246 of the housing 242 when the hand guard 226 is disposed over the barrel 56.

The piston housing support system further includes a support block 280 attached to the first segment 258 and abutting the barrel 56 for supporting the housing 242 relative to the front sight 236 and the barrel 56. More specifically, the support block 280 is attached to at least one of the first base 260 and the first flange 264. Most specifically, the support block 280 is attached to the first flange 264. The support block 280 can be attached to the first segment 258 by fasteners, welding, adhesive or any other suitable method. Alternatively, the support block 280 and the first segment 258 may be integrally formed to each other.

The piston housing support system also includes a stem 282 attached to the support block 280 and the front sight 236. More specifically, the stem 282 is pinned to the front sight 236 and the stem 282 is attached to the support block 280 by any suitable method, such as fasteners, welding, adhesive, etc. The first segment 258 and the support block 280 each define a first opening 284 for receiving the stem 282. The stem 282 defines a second opening 286 in fluid communication with the barrel 56 and the housing 242 for routing exhaust gases from the barrel 56 into the first chamber 252 of the housing 242 to move the piston 254 from the static position to the displaced position. More specifically, the second opening 286 is in fluid communication with the first port 66 of the barrel 56 and the second port 249 of the housing 242.

Obviously, many modifications and variations of the present invention are possible in light of the above teachings. The foregoing invention has been described in accordance with the relevant legal standards; thus, the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A firearm comprising:

a barrel defining a first bore extending along a longitudinal axis and having a breech and a muzzle defining a length of said barrel;

a hand guard defining a second bore extending substantially parallel to said longitudinal axis and having a first end coupled to said breech and a second end spaced from said first end along said longitudinal axis toward said muzzle;

a housing coupled to said second end of said hand guard and defining a chamber extending along a piston axis;

a piston disposed within said chamber of said housing and movable along said piston axis between a static position and a displaced position;

a receiver coupled to said first end of said hand guard and said breech of said barrel with said receiver defining a third bore extending substantially parallel to said longitudinal axis;

a bolt carrier disposed in said third bore of said receiver and moveable relative to said receiver along said longitudinal axis between a firing position and a rearward position;

a carrier key attached to said bolt carrier and moving concurrently with said bolt carrier between said firing and rearward positions with said carrier key extending outwardly above said bolt carrier and along said piston axis; and a rod permanently affixed to said carrier key and extending along said piston axis to a distal end with said piston adjacent said distal end when in said static position and said piston engaging said distal end when moving to said displaced position for moving said bolt carrier from said firing position to said rearward position.

2. A firearm as set forth in claim 1 wherein said rod is further defined as a solid rod.

3. A firearm as set forth in claim 2 further including a first bushing coupled to said hand guard adjacent said first end and defining a first hole along said piston axis with said solid rod continuously disposed through said first hole for guiding said solid rod during movement between said firing and rearward positions.

4. A firearm as set forth in claim 3 wherein said first bushing and said hand guard are integrally formed of a homogeneous metal material.

5. A firearm as set forth in claim 2 further including a second bushing coupled to said hand guard adjacent said second end and defining a second hole along said piston axis with said solid rod disposed in said second hole when in said firing position and said solid rod spaced from said second hole when in said rearward position.

6. A firearm as set forth in claim 5 wherein said second bushing is further defined as a base slideably supported by said hand guard and movable between a charging motion and a forward assist motion.

7. A firearm as set forth in claim 5 wherein said second hole of said second bushing defines a first inner diameter and a second inner diameter less than said first inner diameter to define a lip therebetween and said solid rod defines a first outer diameter and a second outer diameter less than said first outer diameter to define a shoulder therebetween with said shoulder and said lip engaging each other when in said firing position.

8. A firearm as set forth in claim 2 wherein said solid rod and said carrier key are integrally formed of a homogeneous metal material with said bolt carrier, said carrier key and said solid rod removable as a unit from said receiver.

9. A firearm as set forth in claim 1 wherein said barrel defines a first port and said housing defines a second port in fluid communication with said first port for routing exhaust gases into said chamber of said housing to move said piston from said static position to said displaced position.

10. A firearm as set forth in claim 9 wherein said housing defines a bleed-off port transverse to said piston axis for expelling exhaust gases out of said chamber and into said hand guard when said piston is in said displaced position.

11. A firearm as set forth in claim 9 wherein said piston includes a front surface and a back surface spaced from each other relative to said piston axis with saidback surface having a shaft extending along said piston axis for engaging said distal end of said rod when exhaust gases move into said chamber.

12. A firearm as set forth in claim 11 further including a regulator partially disposed in said housing and abutting said front surface of said piston when said piston is in said static position with said regulator defining a plurality of apertures each having a different diameter with one of said apertures in fluid communication with said second port for routing exhaust gases from said barrel to said chamber of said housing.

13. A firearm as set forth in claim 11 wherein said housing defines a first diameter and a second diameter less than said first diameter to define a rim therebetween with said first diameter complimentary in configuration to said piston and said second diameter complimentary in configuration to said shaft.

14. A firearm as set forth in claim 1 further including a front sight including a body with said housing attached to said body and further including a first support coupled to said hand guard adjacent said second end with said front sight and said housing being supported by said first support.

15. A firearm as set forth in claim 14 wherein said first support and said hand guard are integrally formed of a homogenous metal material.

16. A firearm as set forth in claim 14 wherein said first support includes a seat supporting said housing and a projection extending from said second end of said hand guard and supporting said body.

17. A firearm as set forth in claim 14 wherein said piston includes a shaft extending out of said housing along said piston axis toward said distal end of said rod for engaging said distal end and further including a second support coupled to said hand guard and spaced from said first support with said second support defining a first passage along said piston axis and said shaft continuously disposed through said first passage during movement between said static and displaced positions.

18. A firearm as set forth in claim 17 further including a third support coupled to said hand guard adjacent said distal end of said rod and said second support disposed between said first and third supports with said third support defining a second passage along said piston axis and said shaft continuously disposed through said second passage during movement between said static and displaced positions.

19. A firearm as set forth in claim 1 further including a front sight attached to said barrel and including a front side and a back side spaced from each other relative to said longitudinal axis with said housing coupled to said back side.

20. A firearm as set forth in claim 19 wherein said muzzle includes a distal tip and said muzzle is defined as a distance from said front side of said front sight to said distal tip.

21. A firearm as set forth in claim 1 further including a front sight including a body and an extension coupled to said body with said housing attached to said body of said front sight and said body attached to said second end of said hand guard.

* * * * *